US007326161B2

(12) United States Patent
Ishikawa

(10) Patent No.: US 7,326,161 B2
(45) Date of Patent: Feb. 5, 2008

(54) FOLDER

(75) Inventor: Akira Ishikawa, Noda (JP)

(73) Assignee: Komori Corporation, Tokyo (JP)

( * ) Notice: Subject to any disclaimer, the term of this patent is extended or adjusted under 35 U.S.C. 154(b) by 216 days.

(21) Appl. No.: 11/116,363

(22) Filed: Apr. 28, 2005

(65) Prior Publication Data

US 2005/0245379 A1 Nov. 3, 2005

(30) Foreign Application Priority Data

Apr. 30, 2004 (JP) ..... 2004-136131
Mar. 28, 2005 (JP) ..... 2005-090759

(51) Int. Cl.
*B31B 1/16* (2006.01)

(52) U.S. Cl. ..... 493/25; 493/23; 493/34; 493/405; 493/424; 270/20.1; 270/21.1

(58) Field of Classification Search ..... 493/23–25, 493/34, 405, 424, 442, 444, 359, 360, 476, 493/427–429, 454; 270/20.1, 21.1
See application file for complete search history.

(56) References Cited

U.S. PATENT DOCUMENTS 4,176,833 A * 12/1979 Heimlicher ..... 493/324
5,279,195 A 1/1994 Breton
5,443,437 A * 8/1995 Mack ..... 493/359
6,280,373 B1 8/2001 Lanvin
6,440,049 B1 8/2002 Belanger et al.
6,454,692 B2 * 9/2002 Ganneval et al. ..... 493/424
6,689,031 B2 * 2/2004 Nanba et al. ..... 493/22

FOREIGN PATENT DOCUMENTS

EP 0257390 A1 3/1988
JP 7-43097 Y2 10/1995
JP 3377239 B2 12/2002

* cited by examiner

*Primary Examiner*—Hemant M. Desai
(74) *Attorney, Agent, or Firm*—Birch, Stewart, Kolasch & Birch, LLP

(57) ABSTRACT

A folder includes a cut-off cylinder, etc. for cutting a web into sheets; a group of cylinders for folding each sheet into a signature in accordance with the selected folding specifications; and a conveyer apparatus, a fan wheel, a delivery conveyer, etc. for conveying signatures. In the folder, a cutting blade, etc. are disposed on the upstream side of the cut-off cylinder with respect to the feed direction of the web. When the folding specifications of signatures are changed or when the width of the web is changed, a control device operates the cutting blade to cut the web, and controls the feed of the web in such a manner that only a cut portion of the web present on the downstream side of the cut blade with respect to the feed direction is conveyed to the delivery conveyer.

15 Claims, 17 Drawing Sheets

FOLDER

The entire disclosure of Japanese Patent Application No. 2004-136131 filed on Apr. 30, 2004, and Japanese Patent Application No. 2005-090759 filed on Mar. 28, 2005, including specification, claims, drawings and summary is incorporated herein by reference in its entirety.

BACKGROUND OF THE INVENTION

1. Field of the Invention

The present invention relates to a folder that cuts fed web into sheets and folds the sheets into signatures in accordance with selected folding specifications.

2. Description of the Related Art

FIG. 17 shows a conventional folder that cuts fed web into sheets and folds the sheets into signatures in accordance with selected folding specifications (as disclosed in, for example, Japanese Utility Model Publication (kokoku) No. H07-43097 and Japanese Patent Application Laid-Open (kokai) No. H06-1526).

As shown in FIG. 17, a pair of upper tension rollers 111*a* and 111*b* is disposed above a pair of lower tension rollers 112*a* and 112*b*. A cross perforating cylinder 113*a* for perforating printed web 1 in the width direction of the web 1, and a corresponding bearing cylinder 113*b* are disposed between the upper tension rollers 111*a* and 111*b* and the lower tension rollers 112*a* and 112*b*.

A cut-off cylinder 121 having a cut-off knife and adapted to cut the printed web 1 in the width direction of the web 1 is disposed under the lower tension rollers 112*a* and 112*b*. The cut-off cylinder 121 is in contact with a folding cylinder 122. The folding cylinder 122 has pins and folding blades. The pins are adapted to hold a leading end portion of a sheet, which has been cut off from the web 1. The folding blades are adapted to fold the sheet along the width direction thereof at an arbitrary position. The folding cylinder 122 is in contact with a first jaw cylinder 123. The first jaw cylinder 123 has gripper boards and folding blades. The gripper boards are adapted to grip the folded portion of the sheet. The folding blades can be set in such a manner as to fold a signature 2, which has been formed as a result of the sheet being folded, at an arbitrary position along the width direction of the signature 2. The first jaw cylinder 123 is in contact with a second jaw cylinder 124, which has gripper boards for gripping the signature 2 at an arbitrary position.

In the vicinity of the second jaw cylinder 124 is disposed a conveyor apparatus 131 for conveying the signature 2 by means of conveyance belts 131*b* wound around and extending between rollers 131*a*. A fan wheel 132 is disposed downstream of the conveyor apparatus 131 with respect to the conveying direction of the conveyance belts 131*b*. A delivery conveyor 133 for delivering the signatures 2 is disposed under the fan wheel 132. In FIG. 17, reference numeral 134 denotes a chopper blade.

Next will be described the operation of the thus-configured conventional folder.

When the fed web 1 passes through between the cross perforating cylinder 113*a* and the bearing cylinder 113*b* via the upper tension rollers 111*a* and 111*b*, the cross perforating cylinder 113*a* perforates the web 1 across its width at predetermined longitudinal intervals. Subsequently, while the web 1 is passing through between the cut-off cylinder 121 and the folding cylinder 122 via the lower tension rollers 112*a* and 112*b*, the cut-off cylinder 121 cuts the web 1 at the predetermined longitudinal intervals into sheets. The sheets are held on the folding cylinder 122.

When the sheet held on the folding cylinder 122 is conveyed to the contact position where the folding cylinder 122 is in contact with the first jaw cylinder 123, the folding blade of the folding cylinder 122 and the gripper board of the first jaw cylinder 123 cooperatively perform gripping change on the sheet in such a manner that the sheet is folded at an arbitrary position and gripped by the first jaw cylinder 123. Thus, the sheet is held on the first jaw cylinder 123 in the form of the signature 2.

When the signature 2 held on the first jaw cylinder 123 is conveyed to the contact position where the first jaw cylinder 123 is in contact with the second jaw cylinder 124, and is to be folded further, the folding blade of the first jaw cylinder 123 and the gripper board of the second jaw cylinder 124 cooperatively perform gripping changes on the signature 2 in such a manner that the signature 2 is folded further and gripped by the second jaw cylinder 124. In the case where the signature 2 does not need to be folded further, the signature 2 merely undergoes a gripping change from the first jaw cylinder 123 to the second jaw cylinder 124 and is held on the second jaw cylinder 124. In this manner, the sheet is formed into the signature 2 of a parallel single-time folding (double folding), a parallel two-time holding (quarto folding), or a delta folding (triple folding).

The signature 2 held on the second jaw cylinder 124 is transferred to the conveyance belts 131*b* of the conveyor apparatus 131 and conveyed by the conveyor apparatus 131. The thus-conveyed signature 2 is delivered onto the delivery conveyor 133 via the fan wheel 132 and conveyed to the next step.

According to the conventional folder, for example, when the width of the web 1 is changed as a result of connection of the web 1 of a different width to the preceding web 1 or when folding specifications for the signature 2 are to be changed in the course of printing, the folder is halted before the web 1 of the different width enters the folder or before the folding specifications are changed. Then, an operator manually removes a piece of the web 1, sheets, and the signatures 2 from the interior of the folder and modifies settings of internal mechanisms, such as the conveyor apparatus 131, of the folder, in accordance with the new width of the web 1 or new folding specifications. Subsequently, the operator starts the folder to resume folding. Thus, work efficiency is very poor, and printing cost is increased.

SUMMARY OF THE INVENTION

In view of the foregoing, an object of the present invention provides a folder capable of readily coping with a change in the web width or folding specifications.

To achieve the foregoing, a folder according to a first aspect of the present invention comprises: cut-off means for cutting fed web into sheets; folding means for folding the sheets into signatures in accordance with selected folding specifications; signature conveyance means for conveying the signatures; first web cutting means disposed upstream of the cut-off means with respect to a feed direction of the web and adapted to cut the web; and control means, operable when the folding specifications of the signatures are changed or a width of the web is changed, for operating the first web cutting means so as to cut the web, and for causing the cut web present downstream of the first web cutting means with respect to the feed direction to be fed to the signature conveyance means.

According to a second aspect of the present invention, in the folder according to the first aspect, when the folding specifications of the signatures are changed, the control means changes the setting of (adjusts) the folding means on the basis of new folding specifications.

According to a third aspect of the present invention, the folder according to the first aspect further comprises signature detection means for detecting the presence/absence of the signature on the signature conveyance means, wherein when the folding specifications of the signatures are changed, the control means changes the setting of (adjusts) the folding means on the basis of a signal from the signature detection means.

According to a fourth aspect of the present invention, in the folder according to the second aspect, the folding means comprises a double-cylinder-type folding cylinder composed of a folding-cylinder first cylinder and a folding-cylinder second cylinder coaxially assembled to the folding-cylinder first cylinder in such a manner that the folding-cylinder second cylinder can move in a circumferential direction, wherein a pin for holding a sheet produced as a result of cutting of the web by the cut-off means is provided on the fold-cylinder first cylinder, and a folding blade for folding the sheet is provided on the folding-cylinder second cylinder; a double-cylinder-type first jaw cylinder composed of a first-jaw-cylinder first cylinder and a first-jaw-cylinder second cylinder coaxially assembled to the first-jaw-cylinder first cylinder in such a manner that the first-jaw-cylinder second cylinder can move in a circumferential direction, wherein a gripper board for gripping a folded portion of the sheet folded by the folding cylinder is provided on the first-jaw-cylinder first cylinder, and a folding blade for folding a signature, which has been formed as a result of the sheet being folded, is provided on the first-jaw-cylinder second cylinder; folding-cylinder phase adjustment means for adjusting a phase relation between the folding-cylinder first cylinder and the folding-cylinder second cylinder; and first-jaw-cylinder phase adjustment means for adjusting a phase relation between the first-jaw-cylinder first cylinder and the first-jaw-cylinder second cylinder, wherein the control means operates the folding-cylinder phase adjustment means and the first-jaw-cylinder phase adjustment means on the basis of new folding specifications.

According to a fifth aspect of the present invention, the folder according to the first aspect further comprises feed direction changeover means disposed upstream of the first web cutting means with respect to the feed direction and adapted to change a web feed direction so as to guide to a web ejection path the upstream web formed as a result of cutting, wherein when the width of the web is changed, the control means operates the feed direction changeover means in such a manner as to guide, to the web ejection path, the cut web present on the upstream side of the first web cutting means with respect to the feed direction.

According to a sixth aspect of the present invention, the folder according to the fifth aspect further comprises web feed means disposed upstream of the feed direction changeover means with respect to the feed direction and adapted to feed the web, wherein the control means operates the web feed means to eject, to the web ejection path, the cut web present on the upstream side of the first web cutting means with respect to the feed direction.

According to a seventh aspect of the present invention, the folder according to the sixth aspect further comprises web feed amount detection means for detecting a feed amount of the web, wherein the control means stops the operation of the web feed means on the basis of a signal from the web feed amount detection means.

According to an eighth aspect of the present invention, the folder according to the seventh aspect further comprises second web cutting means disposed upstream of the web feed means with respect to the feed direction and adapted to cut the web, wherein the control means operates the second web cutting means so as to cut a leading end portion of the web having a new width fed to the web ejection path.

According to a ninth aspect of the present invention, in the folder according to the eighth aspect the control means operates the feed direction changeover means in such a manner as to guide, to a web feed path, the web cut by the second web cutting means and located on the upstream side of the second web cutting means with respect to the feed direction.

According to a tenth aspect of the present invention, the folder according to the fifth aspect further comprises signature detection means for detecting the presence/absence of the signature on the signature conveyance means, wherein the control means operates the feed direction changeover means on the basis of a signal from the signature detection means.

According to an eleventh aspect of the present invention, in the folder according to the first aspect, the signature conveyance means is disposed downstream of the folding means with respect to the conveyance direction of the signature.

According to a twelfth aspect of the present invention, the folder according to the tenth aspect further comprises signature detection means for detecting the presence/absence of the signature on the signature conveyance means, wherein when the folding specifications of the signatures are changed, the control means ejects the signatures from the cut-off means, the folding means, and the signature conveyance means, on the basis of a signal from the signature detection means.

According to a thirteenth aspect of the present invention, in the folder according to the first aspect, the cut-off means comprises a cut-off cylinder having a cut-off knife; the folding means comprises a group of cylinders including a folding cylinder which has a pin for holding the sheet produced as a result of cutting of the web, and a folding blade for folding the sheet at an arbitrary position; and the signature conveyance means receives the signatures from the group of cylinders and conveys the signatures.

According to a fourteenth aspect of the present invention, the folder according to the first aspect further comprises feed direction changeover means disposed upstream of the first web cutting means with respect to the feed direction and adapted to change a web feed direction so as to guide, to the web ejection path, the cut web present on the upstream side of the first web cutting means with respect to the feed direction; web feed means disposed upstream of the feed direction changeover means with respect to the feed direction and adapted to feed the web; web feed amount detection means for detecting a feed amount of the web; and second web cutting means disposed upstream of the web feed means with respect to the feed direction and adapted to cut the web. When the folding specifications are changed to new folding specifications, the control means changes the setting of (adjusts) the folding means on the basis of a signal from the signature detection means. When the web width is switched to a new web width, after operating the feed direction changeover means in such a manner as to guide, to the web ejection path, the cut web present on the upstream side of the first web cutting means with respect to the feed direction, the control means operates the web feed means to eject, to the web ejection path, the cut web present on the upstream side of the first web cutting means with respect to the feed direction, stops the operation of the web feed means when the web having a new width reaches a position facing the second web cutting means, operates the second web cutting means so as to cut the web having a new width, and operates the feed direction changeover means in such a manner as to guide, to a web feed path, the web having a new width cut by the second web cutting means and located on the upstream side of the second web cutting means with respect to the feed direction.

According to a fifteenth aspect of the present invention, in the folder according to the fourteenth aspect, the cut-off means, the folding means, and the signature conveyance means are designed to be operated by power from a main power source. The web feed means comprises first feed rollers which are paired to nip the web and operated by the power from the main power source. The folder comprises a secondary power source for operating the cut-off means, the folding means, and the signature conveyance means, a first clutch provided between the main power source and the cut-off means, the folding means, and the signature conveyance means, and a second clutch provided between the secondary power source and the cut-off means, the folding means, and the signature conveyance means. When the cut-off means, the folding means, the signature conveyance means, and the first feed rollers are to be operated, the control means brings the second clutch into a disengaged state, brings the first clutch into an engaged state, and activates the main power source. When the first feed rollers are to be operated without operating the cut-off means, the folding means, and the signature conveyance means, the control means brings the first and second clutches into the disengaged state and activates the main power source, or the control means brings the first clutch into the disengaged state, stops the secondary power source, and activates the main power source. When only the cut-off means, the folding means, and the signature conveyance means are to be operated, the control means brings the first clutch into the disengaged state, stops the main power source, brings the second clutch into the engaged state, and activates the secondary power source.

Even when folding specifications for signatures are to be changed in the course of printing or even when the width of web is changed as a result of connection of web of a different width to the preceding web, the folder according to the present invention frees an operator of the following work: manual removal of a piece of web, sheets, and signatures from the interior of the folder and subsequent modification of settings (adjustment) of internal mechanisms of the folder. Thus, the folder of the present invention can readily cope with a change in the width of web or folding specifications, thereby greatly enhancing work efficiency. Therefore, the folder of the present invention is very useful in the printing industry, the bookbinding industry, and the like.

DESCRIPTION OF THE PREFERRED EMBODIMENT

Figure 1:
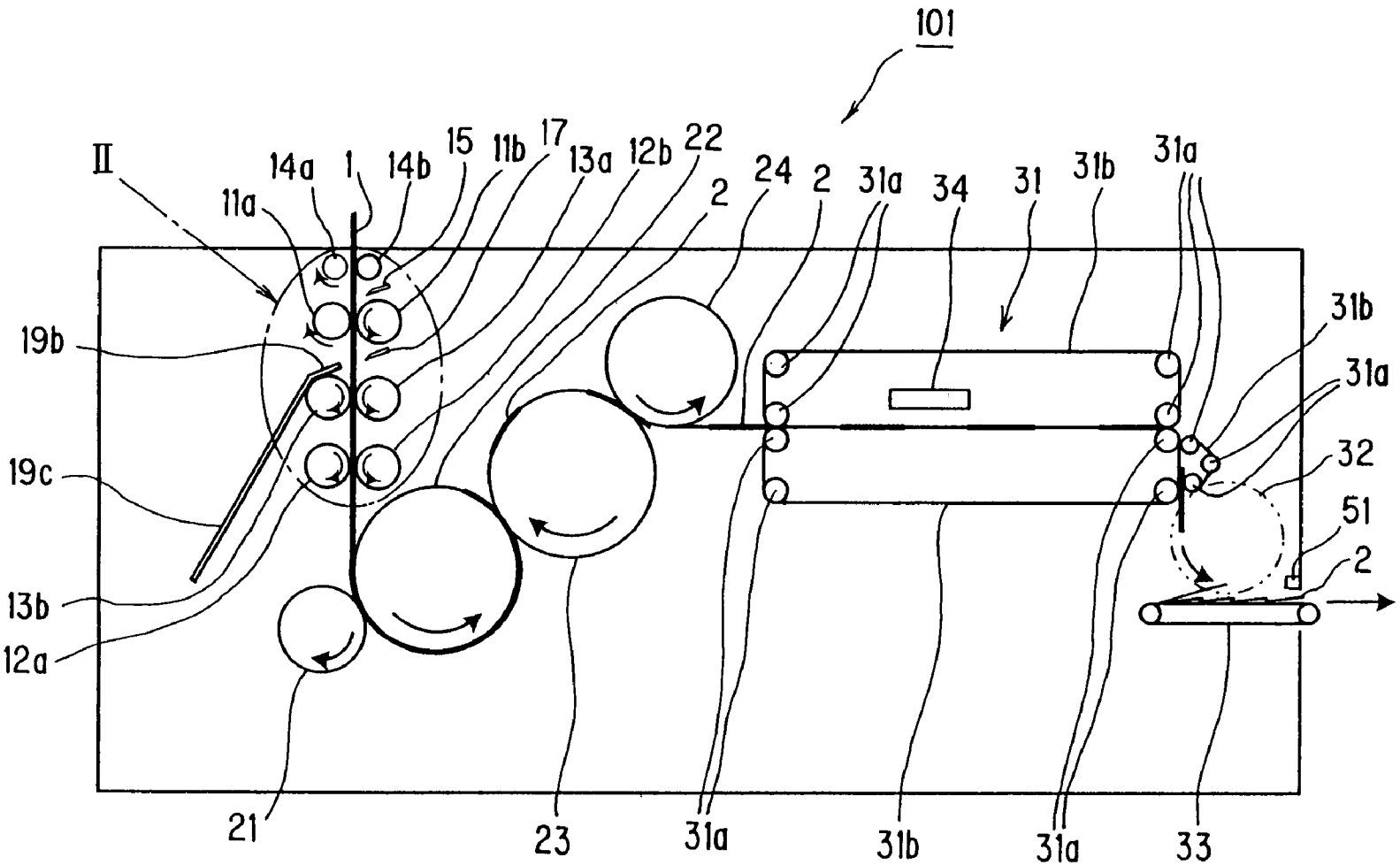
FIG. 1 is a schematic, overall, configurational view of an embodiment of a folder according to the present invention.
Figure 2:
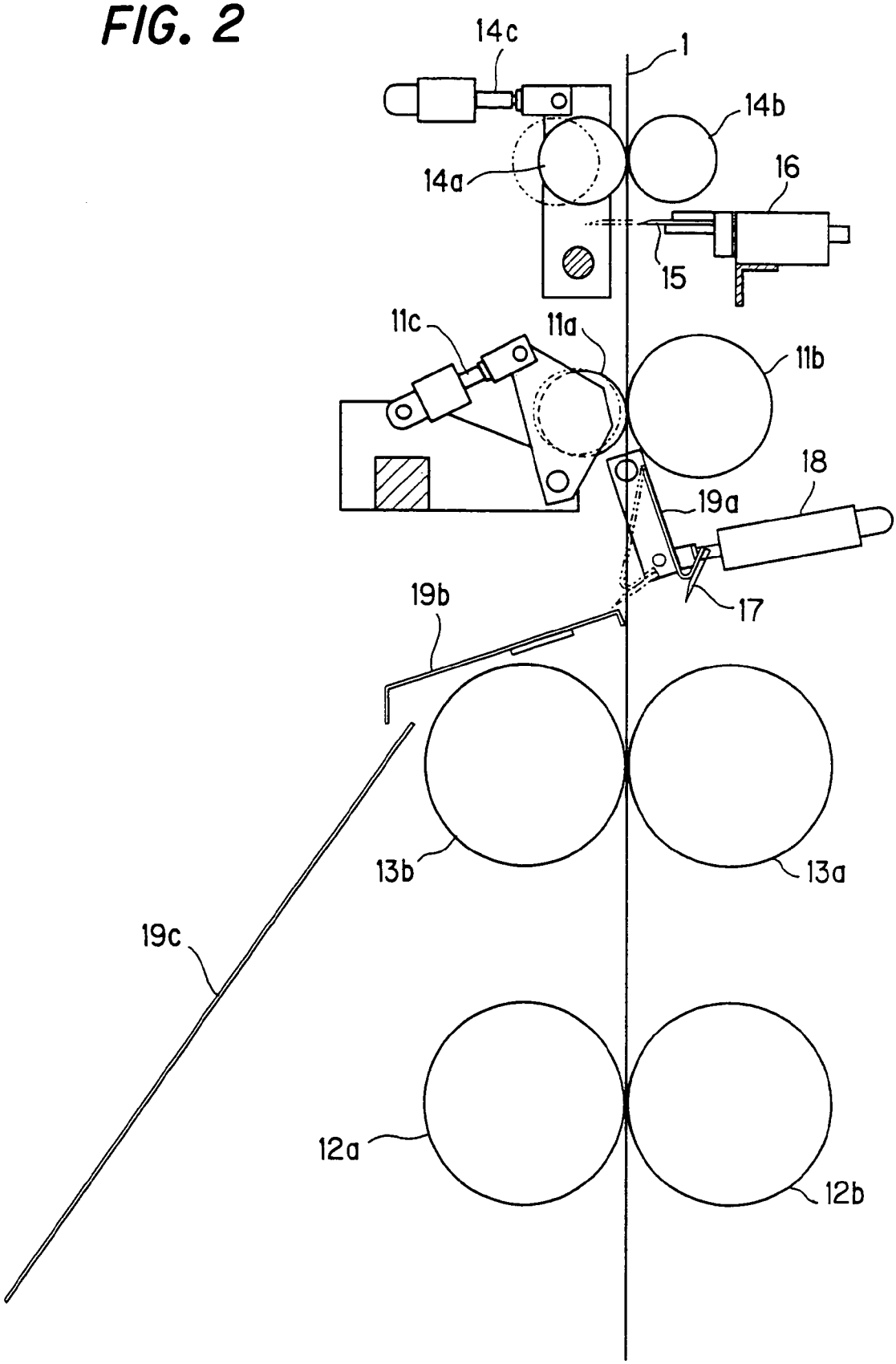
FIG. 2 is an enlarged view of a region II of FIG. 1.
Figure 3:
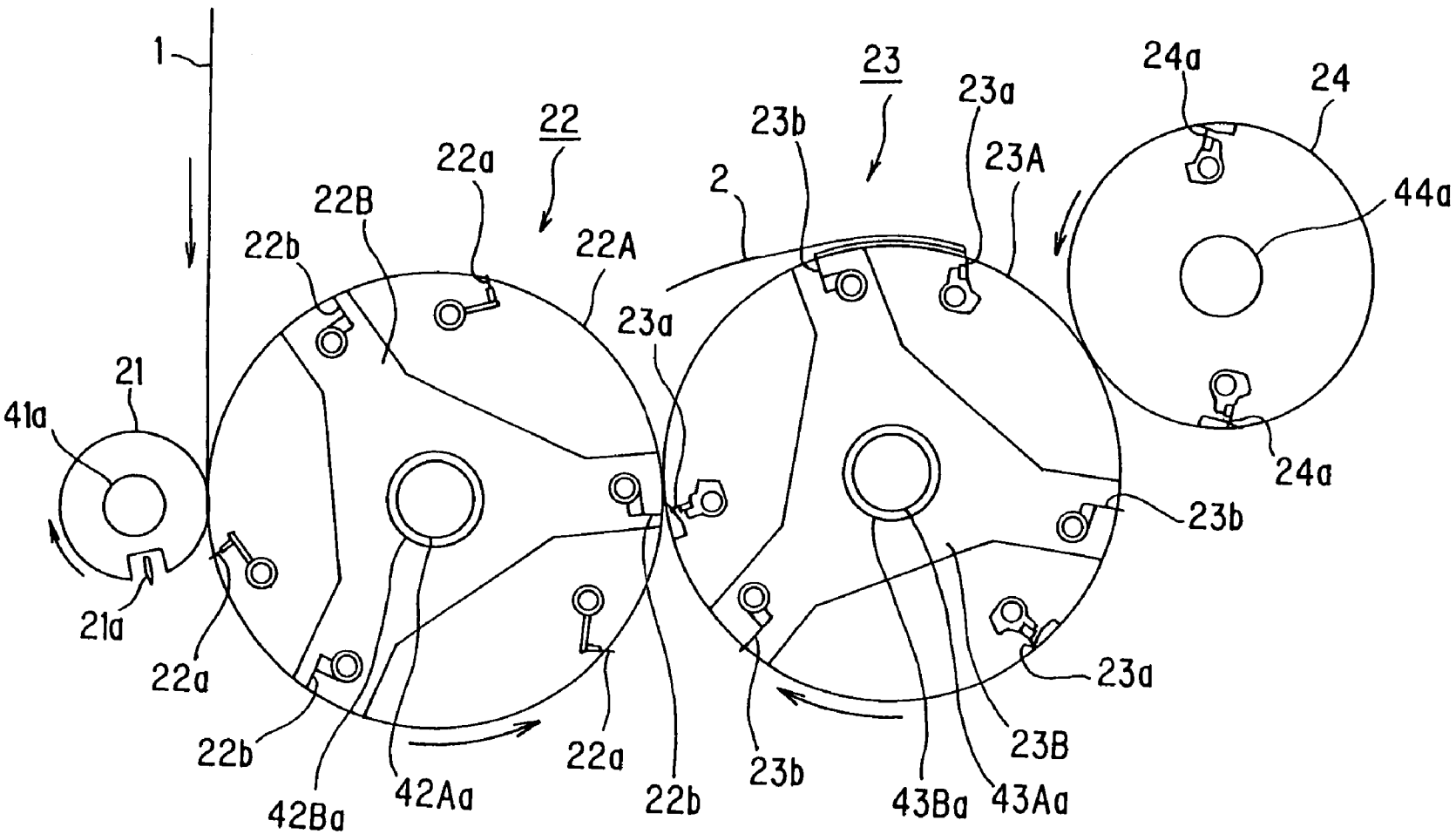
FIG. 3 is a schematic, configurational view of the cut-off cylinder, folding cylinder, first jaw cylinder, and second jaw cylinder of FIG. 1.
Figure 4:
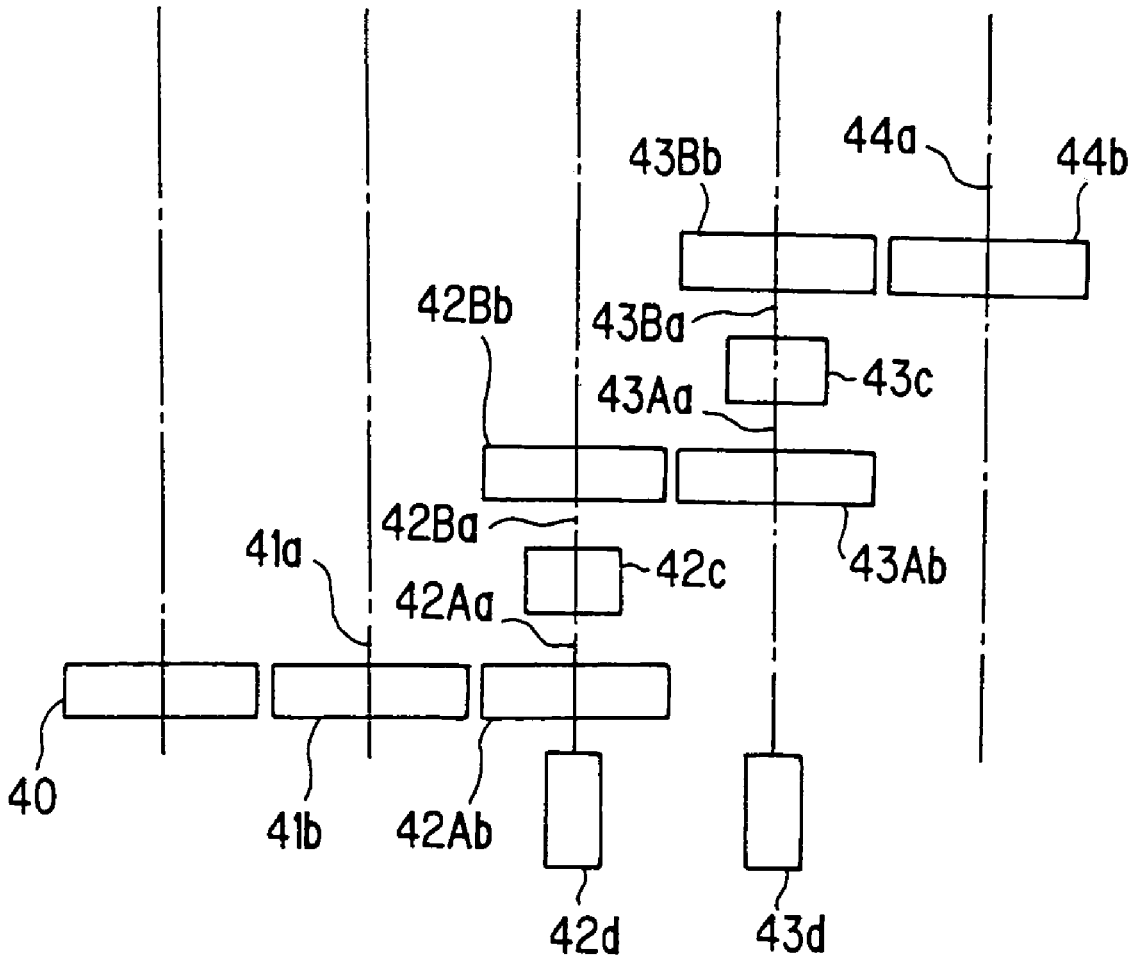
FIG. 4 is a schematic, configurational view of a drive system for the cut-off cylinder, folding cylinder, first jaw cylinder, and second jaw cylinder of FIG. 1.
Figure 5:
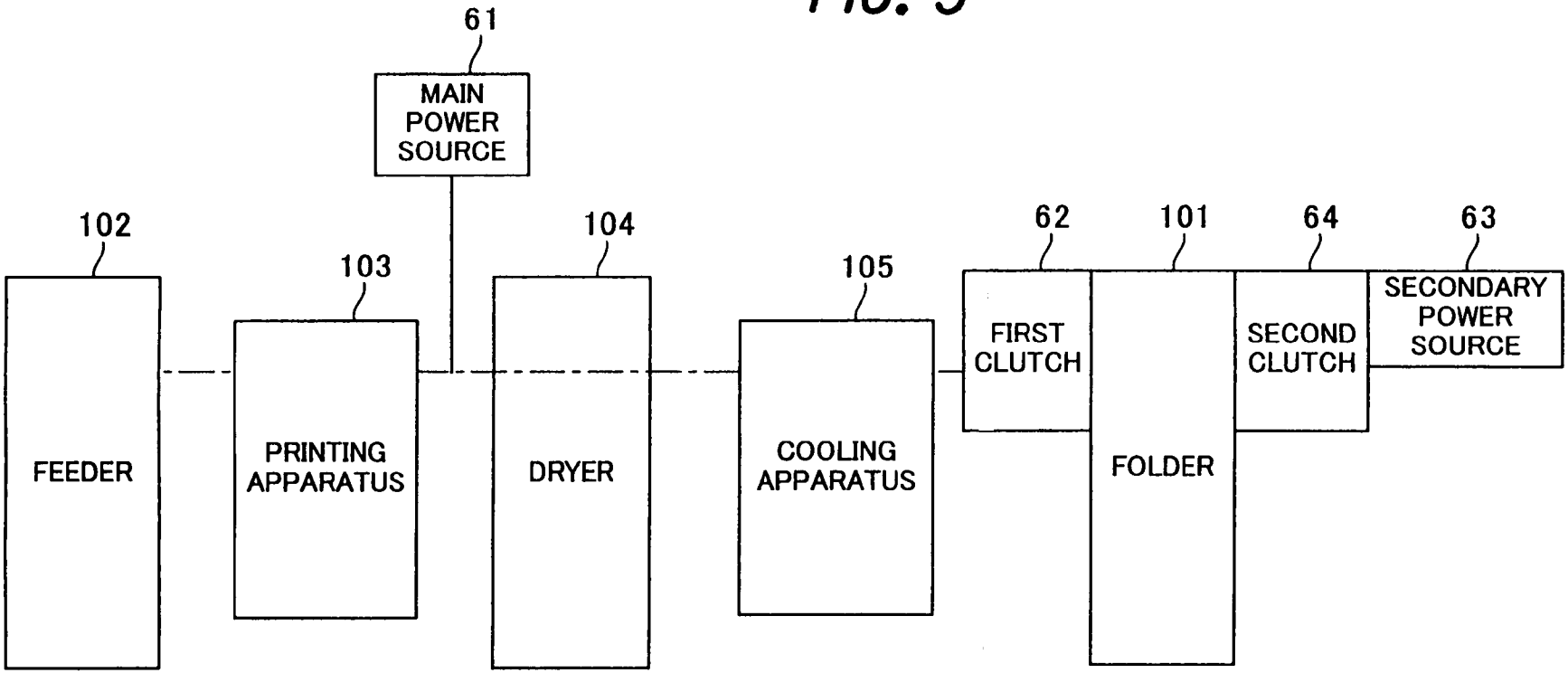
FIG. 5 is a block diagram of a drive system for an embodiment of a printing press into which the folder according to the present invention is incorporated.
Figure 6:
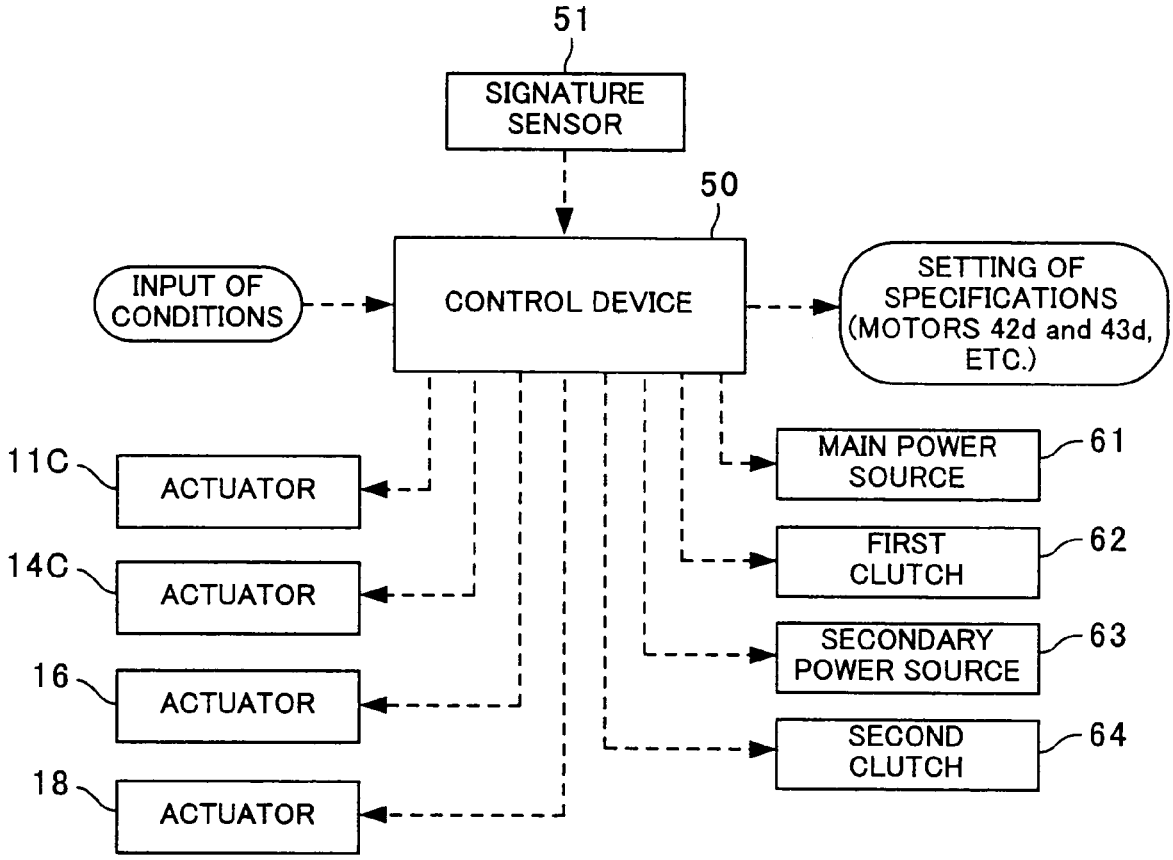
FIG. 6 is a block diagram of a control system of the printing press of FIG. 5.

An embodiment of a folder according to the present invention will next be described in detail with reference to FIGS. 1 to 6. FIG. 1 is a schematic, overall, configurational view of a folder; FIG. 2 is an enlarged view of a region II of FIG. 1; FIG. 3 is a schematic, configurational view of the cut-off cylinder, folding cylinder, first jaw cylinder, and second jaw cylinder of FIG. 1; FIG. 4 is a schematic, configurational view of a drive system for the cut-off cylinder, folding cylinder, first jaw cylinder, and second jaw cylinder of FIG. 1; FIG. 5 is a block diagram of a drive system for an embodiment of a printing press into which the folder of FIG. 1 is incorporated; and FIG. 6 is a block diagram of a control system.

As shown in FIGS. 1 and 2, a folder 101 according to the present embodiment is configured as follows. Two upper tension rollers 11*a* and 11*b* are disposed above two lower tension rollers 12*a* and 12*b*. The upper tension rollers 11*a* and 11*b* are paired in such a manner as to nip a web 1 therebetween and serve as paired first feed rollers. The lower tension rollers 12*a* and 12*b* are paired in such a manner as to nip the web 1 therebetween and serve as paired third feed rollers. A cross perforating cylinder 13*a* for perforating the printed web 1 in the width direction of the web 1, and a corresponding bearing cylinder 13*b* are disposed between the upper tension rollers 11*a* and 11*b* and the lower tension rollers 12*a* and 12*b*. Two auxiliary rollers 14*a* and 14*b* are disposed above the upper tension rollers 11*a* and 11*b*. The auxiliary rollers 14*a* and 14*b* are paired in such a manner as to nip the web 1 therebetween and serve as paired second feed rollers.

An actuator 11*c* serves as first-feed-roller-moving means and causes the upper tension roller 11*a* to move toward or away from the other upper tension roller 11*b*. An actuator 14*c* serves as second-feed-roller-moving means and causes the auxiliary roller 14*a* to move toward or away from the other auxiliary roller 14*b*.

A cutting blade 15 is disposed between the auxiliary rollers 14*a* and 14*b* and the upper tension rollers 11*a* and 11*b*. An actuator 16 causes the cutting blade 15 to cut the web 1 along the width direction of the web 1. A guide plate 19*a* is disposed between the upper tension rollers 11*a* and 11*b*, and the cross perforating cylinder 13*a* and the bearing cylinder 13*b*. The guide plate 19*a* is supported in such a manner as to be pivotable about its upper end. A cutting blade 17 is disposed on the lower end of the guide plate 19*a*.

The tip end of an actuator 18 is pin-connected to the lower end of the guide plate 19*a*. Extension of the rod of the actuator 18 causes the cutting blade 17 to cut the web 1 along the width direction of the web 1, and causes the lower end of the guide plate 19*a* to be positioned on the pass line of the web 1, whereby the feed direction of the upstream web 1 formed as a result of cutting can be changed over from the paper feed path (web feed path) (extending downward in FIGS. 1 and 2) to the paper ejection path (web ejection path) (extending leftward in FIGS. 1 and 2), which is formed by guide plates 19*b* and 19*c*.

In the present embodiment, the cutting blade 15, the actuator 16, and other components constitute second web cutting means; the cutting blade 17, the actuator 18, and other components constitute first web cutting means; the actuator 18, the guide plates 19*a* to 19*c*, and other components constitute feed direction changeover means; and the upper tension rollers 11*a* and 11*b*, the actuator 11*c*, and other components constitute web feed means, with the upper tension rollers 11*a* and 11*b* serving as the first feed rollers, and the actuator 11*c* serving as the first-feed-roller-moving means.

As shown in FIGS. 1 and 3, a cut-off cylinder 21 having a cut-off knife 21*a* and adapted to cut the printed web 1 in the width direction of the web 1 is disposed under the lower tension rollers 12*a* and 12*b*. The cut-off cylinder 21 is in contact with a folding cylinder 22 of a double cylinder type in which a folding-cylinder first cylinder 22A and a folding-cylinder second cylinder 22B are coaxially assembled to such a manner that the second cylinder 22B can move in the circumferential direction. A plurality of pins 22*a* are provided on the first cylinder 22A in such a manner as to be circumferentially arranged at predetermined intervals, and adapted to hold a leading end portion of a sheet cut off from the web 1. A plurality of folding blades 22*b* are provided on the second cylinder 22B in such a manner as to be circumferentially arranged at predetermined intervals, and adapted to fold the sheet at an arbitrary position along the width direction of the sheet.

The folding cylinder 22 is in contact with a first jaw cylinder 23 of a double cylinder type in which a first-jaw-cylinder first cylinder 23A and a first-jaw-cylinder second cylinder 23B are coaxially assembled to such a manner that the second cylinder 23B can move in the circumferential direction. A plurality of gripper boards 23*a* for gripping the folded portion of the sheet are provided on the first cylinder 23A in such a manner as to be circumferentially arranged at predetermined intervals. A plurality of folding blades 23*b* are provided on the second cylinder 23B in such a manner as to be circumferentially arranged at predetermined intervals, and adapted to fold a signature 2, which has been formed as a result of the sheet being folded, along the width direction of the signature 2. The first jaw cylinder 23 is in contact with a second jaw cylinder 24, which has gripper boards 24*a* for gripping the signature 2 at an arbitrary position.

As shown in FIG. 4, a cut-off cylinder gear 41*b* engaged with a drive gear 40 is provided on a cut-off cylinder drive shaft 41*a*, which rotates the cut-off cylinder 21. A first-cylinder gear 42Ab engaged with the cut-off cylinder gear 41*b* is provided on a first-cylinder drive shaft 42Aa, which rotates the first cylinder 22A of the folding cylinder 22. A second-cylinder drive shaft 42Ba for rotating the second cylinder 22B of the folding cylinder 22 is connected to the first-cylinder drive shaft 42Aa via a folding-cylinder differential unit 42*c* (composed of a harmonic drive (trademark) unit) adapted to make phase adjustments. A second-cylinder gear 42Bb is provided on the second-cylinder drive shaft 42Ba.

A first-cylinder gear 43Ab engaged with the second-cylinder gear 42Bb is provided on a first-cylinder drive shaft 43Aa, which rotates the first cylinder 23A of the first jaw cylinder 23. A second-cylinder drive shaft 43Ba for rotating the second cylinder 23B of the first jaw cylinder 23 is connected to the first-cylinder drive shaft 43Aa via a first-jaw-cylinder differential unit 43*c* (composed of a harmonic drive (trademark) unit) adapted to make phase adjustments. A second-cylinder gear 43Bb is provided on the second-cylinder drive shaft 43Ba. A second-jaw-cylinder gear 44*b* engaged with the second-cylinder gear 43Bb is provided on a second-jaw-cylinder drive shaft 44*a*, which rotates the second jaw cylinder 24.

A folding-cylinder phase adjustment motor 42*d* is connected to the folding-cylinder differential unit 42*c*. The folding-cylinder phase adjustment motor 42*d* rotates the second-cylinder drive shaft 42Ba so as to change the phase of the second cylinder 22B of the folding cylinder 22 with respect to the first cylinder 22A of the folding cylinder 22. A first-jaw-cylinder phase adjustment motor 43*d* is connected to the first-jaw-cylinder differential unit 43*c*. The first-jaw-cylinder phase adjustment motor 43*d* rotates the second-cylinder drive shaft 43Ba so as to change the phase of the second cylinder 23B of the first jaw cylinder 23 with respect to the first cylinder 23A of the first jaw cylinder 23.

The differential units 42*c* and 43*c* are known differential unit mechanisms, each of which includes, as basic elements, a wave generator, a flexspline externally fitted to the wave generator, a pair of circular splines externally meshed with the flexspline, an output gear bolted to one circular spline, and an input gear bolted to the other circular spline and in which the number of teeth of the individual circular splines is greater than that of the flexspline.

Therefore, when the folding-cylinder phase adjustment motor 42*d* is stopped, the folding-cylinder differential unit 42*c* transmits power from the drive gear 40 intact to the second-cylinder gear 42Bb of the folding cylinder 22 and to the first-cylinder gear 43Ab of the first jaw cylinder 23, via the cut-off cylinder gear 41*b* and the first-cylinder gear 42Ab of the folding cylinder 22. When the first-jaw-cylinder phase adjustment motor 43*d* is stopped, the first-jaw-cylinder differential unit 43*c* transmits power from the first-cylinder gear 43Ab intact to the second-cylinder gear 43Bb of the first jaw cylinder 23 and to the second-jaw-cylinder gear 44*b*.

When the folding-cylinder phase adjustment motor 42*d* is operated, the operation of the folding-cylinder differential unit 42*c* causes a change in the phase of the second-cylinder gear 42Bb of the folding cylinder 22 with respect to the first-cylinder gear 42Ab of the folding cylinder 22. At the same time, the first- and second-cylinder gears 43Ab and 43Bb of the first jaw cylinder 23 and the second-jaw-cylinder gear 44*b* rotate in an interlocking relation with; i.e., synchronously with, rotation of the phase-changed second-cylinder gear 42Bb of the folding cylinder 22 so as to make phase match with the second-cylinder gear 42Bb. When the first-jaw-cylinder phase adjustment motor 43*d* is operated, the operation of the first-jaw-cylinder differential unit 43*c* causes a change in the phase of the second-cylinder gear 43Bb of the first jaw cylinder 23 with respect to the first-cylinder gear 43Ab of the first jaw cylinder 23. At the same time, the second-jaw-cylinder gear 44*b* rotates in an interlocking relation with; i.e., synchronously with, rotation of the phase-changed second-cylinder gear 43Bb of the first jaw cylinder 23 so as to make phase match with the second-cylinder gear 43Bb.

By means of operating the phase adjustment motors 42*d* and 43*d*, the phases of the gears 42Bb, 43Ab, 43Bb, and 44*b* are changed to thereby change the phase relationship among the first and second cylinders 22A and 22B of the folding cylinder 22, the first and second cylinders 23A and 23B of the first jaw cylinder 23, and the second jaw cylinder 24, whereby there can be changed the phase relationship among the pins 22*a* and folding blades 22*b* of the folding cylinder 22, the gripper boards 23*a* and folding blades 23*b* of the first jaw cylinder 23, and the gripper boards 24*a* of the second jaw cylinder 24, and folding specifications or the like for the signature 2 can be changed accordingly.

In the present embodiment, the drive shafts 42Aa and 42Ba, the gears 42Ab and 42Bb, the differential unit 42*c*, the motor 42*d*, etc. constitute folding-cylinder phase adjustment means; the drive shafts 43Aa and 43Ba, the gears 43Ab and 43Bb, the differential unit 43*c*, the motor 43*d*, etc. constitute first-jaw-cylinder phase adjustment means.

As shown in FIG. 1, in the vicinity of the second jaw cylinder 24 is disposed a conveyor apparatus 31 for conveying the signature 2 by means of conveyance belts 31*b* wound around and extending between rollers 31*a*. A fan wheel 32 is disposed downstream of the conveyor apparatus 31 with respect to the conveying direction of the conveyance belts 31*b*. A delivery conveyor 33 for delivering the signatures 2 is disposed under the fan wheel 32. A signature sensor 51, which serves as signature detection means, for detecting the presence/absence of the signature 2 is disposed in the vicinity of the delivery conveyor 33.

In the present embodiment, the cut-off cylinder 21 and other components constitute cut-off means; the folding cylinder 22, the first jaw cylinder 23, the second jaw cylinder 24, and other components constitute a cylinder group and folding means; and the conveyor apparatus 31, the fan wheel 32, the delivery conveyor 33, and other components constitute signature conveyance means. In FIG. 1, reference numeral 34 denotes a chopper plate.

As shown in FIG. 5, the drive gear 40, the conveyor apparatus 31, the fan wheel 32, and the delivery conveyor 33 are connected, via a first clutch 62, to the power transmission system of a main power source 61, which powers a feeder 102, a printing apparatus 103, a dryer 104, a cooling apparatus 105, and the like of the printing press, as well as to a secondary power source 63 via a second clutch 64, the secondary power source 63 exclusively powering the drive gear 40, the conveyor apparatus 31, the fan wheel 32, and the delivery conveyor 33.

The rollers 11*a*, 12*a*, and 14*a*, the cross perforating cylinder 13*a*, and the bearing cylinder 13*b* are connected to the power transmission system of the main power source 61 in the same manner as the feeder 102, the printing apparatus 103, the dryer 104, the cooling apparatus 105, and the like of the printing press; i.e., directly connected to the power transmission system of the main power source 61 without passing through the first clutch 62.

That is, upon activation of the main power source 61, the rollers 11*a*, 12*a*, and 14*a*, the cross perforating cylinder 13*a*, and the bearing cylinder 13*b* are operated together with the feeder 102, the printing apparatus 103, the dryer 104, the cooling apparatus 105, and the like of the printing press. The drive gear 40, the conveyor apparatus 31, the fan wheel 32, and the delivery conveyor 33 are operated upon activation of the main power source 61 when the first clutch 62 is connected. In this case, the drive gear 40, the conveyor apparatus 31, the fan wheel 32, and the delivery conveyor 33 are operated together not only with the rollers 11*a*, 12*a*, and 14*a*, the cross perforating cylinder 13*a*, and the bearing cylinder 13*b* but also with the feeder 102, the printing apparatus 103, the dryer 104, the cooling apparatus 105, and the like of the printing press. When the main power source 61 is stopped, the drive gear 40, the conveyor apparatus 31, the fan wheel 32, and the delivery conveyor 33 are also operated through an operation of bringing the first clutch 62 into a disengaged state, bringing the second clutch 64 into an engaged state, and activating the second power source 63. In this case, the drive gear 40, the conveyor apparatus 31, the fan wheel 32, and the delivery conveyor 33 can be operated independently, while not only the feeder 102, the printing apparatus 103, the dryer 104, the cooling apparatus 105, and the like of the printing press, but also the rollers 11*a*, 12*a*, and 14*a*, the cross perforating cylinder 13*a*, and the bearing cylinder 13*b* are stopped.

As shown in FIG. 6, the output section of a control device 50 is electrically connected to the power sources 61 and 63, the clutches 62 and 64, and the actuators 11*c*, 14*c*, 16, and 18. When conditions, such as the width of the web 1 and folding specifications, are selectively input to the control device 50, the control device 50 activates the phase adjustment motors 42*d* and 43*d*, and the like so as to modify settings of (adjust) internal mechanisms, such as the cylinders 21 to 24 and the conveyor apparatus 31, of the folder 101, in accordance with the selected conditions, such as the selected width of the web 1 or selected folding specifications.

The signature sensor 51 is electrically connected to the input section of the control device 50. When conditions, such as the width of the web 1 and folding specifications, are selectively input to the control device 50, on the basis of a signal from the signature sensor 51, the control device 50 controls the operation of the power sources 62 and 63, the clutches 62 and 64, and actuators 11*c*, 14*c*, 16, and 18 and activates the phase adjustment motors 42*d* and 43*d*, and the like so as to modify settings of (adjust) internal mechanisms, such as the cylinders 21 to 24 and the conveyor apparatus 31, of the folder 101.

Figure 7:
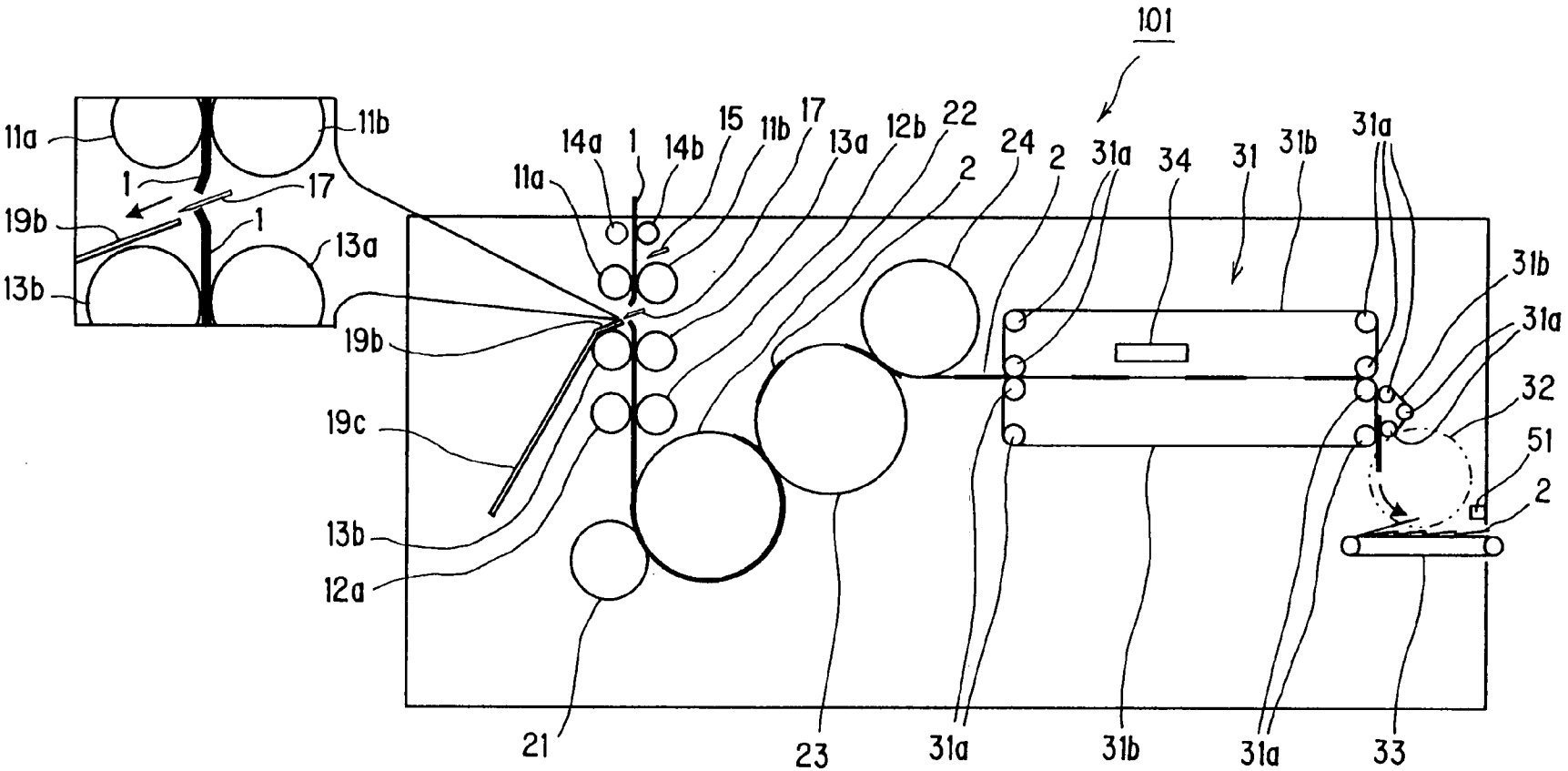
FIG. 7 is an explanatory view for explaining an action of the folder according to the present invention.
Figure 8:
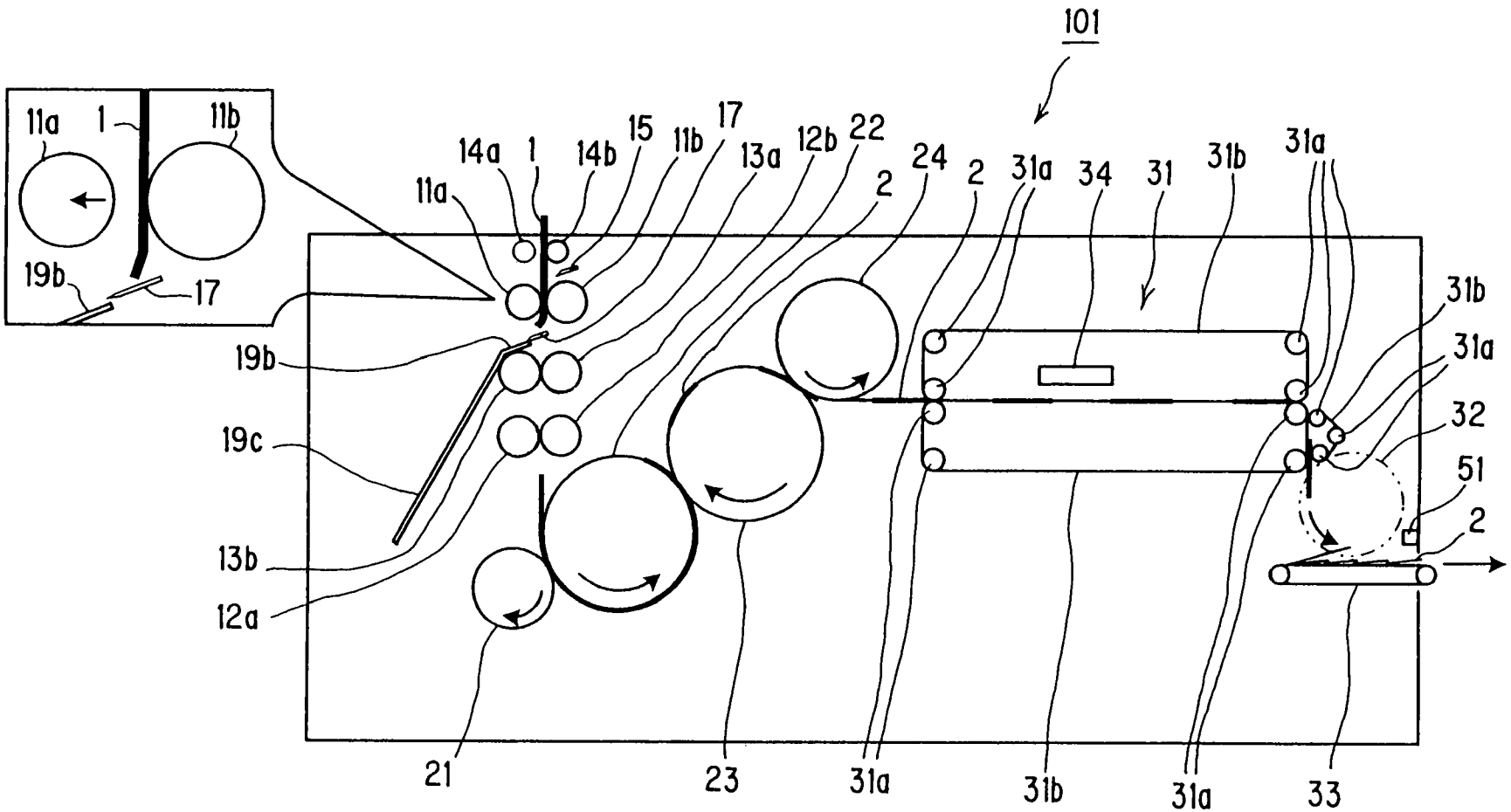
FIG. 8 is an explanatory view for explaining an action subsequent to the action of FIG. 7.
Figure 9:
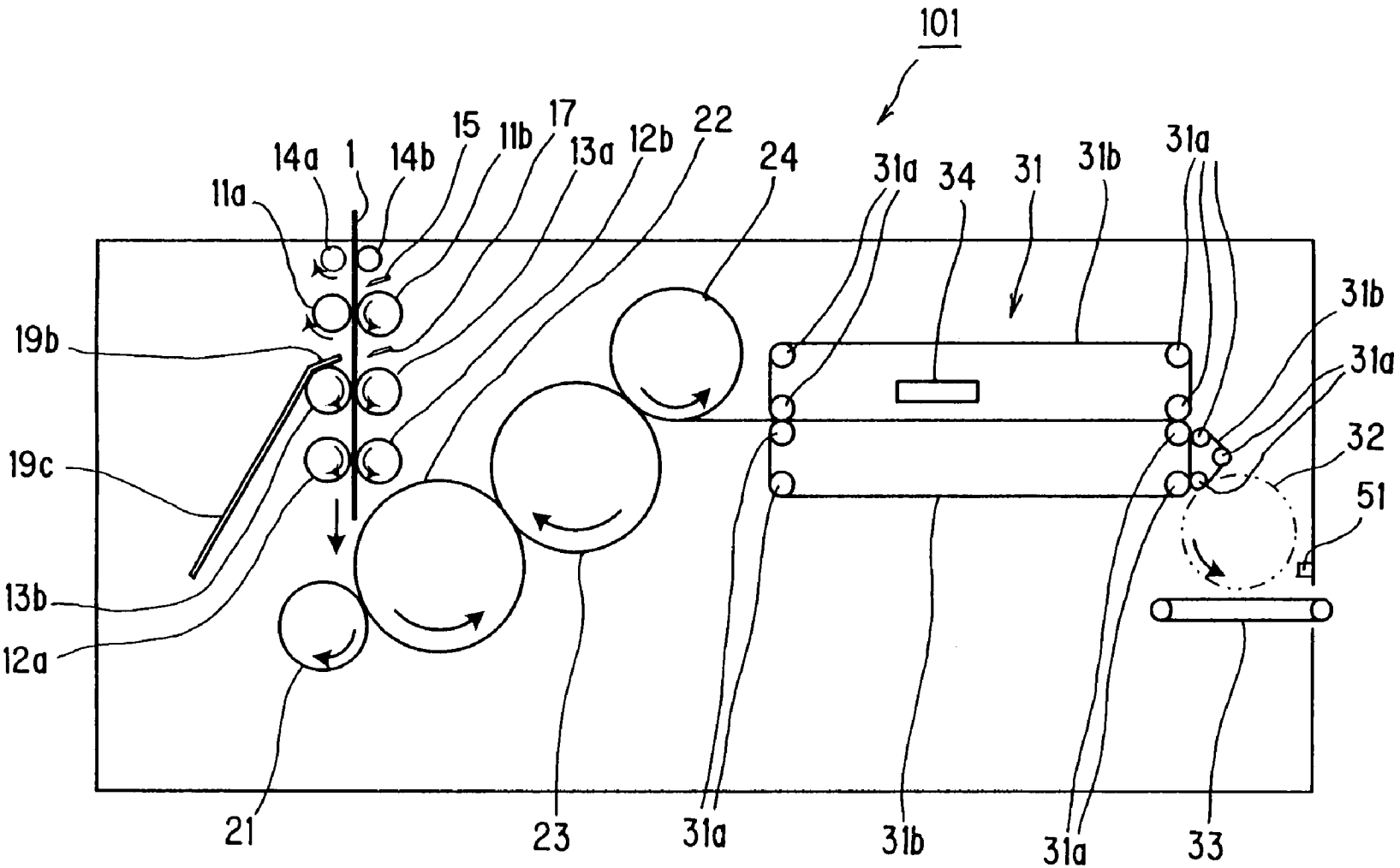
FIG. 9 is an explanatory view for explaining an action subsequent to the action of FIG. 8.
Figure 10:
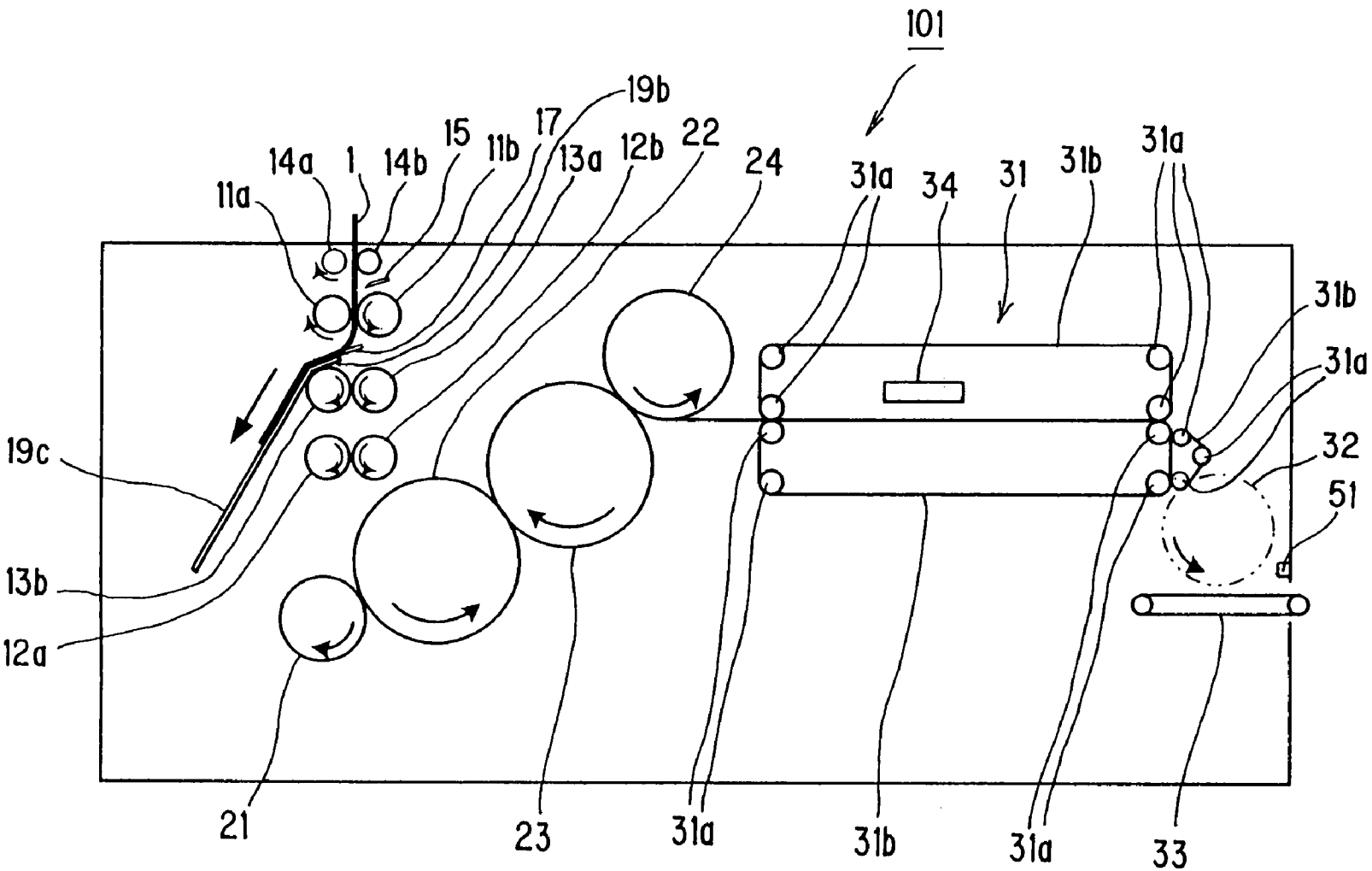
FIG. 10 is an explanatory view for explaining an action subsequent to the action of FIG. 8.
Figure 11:
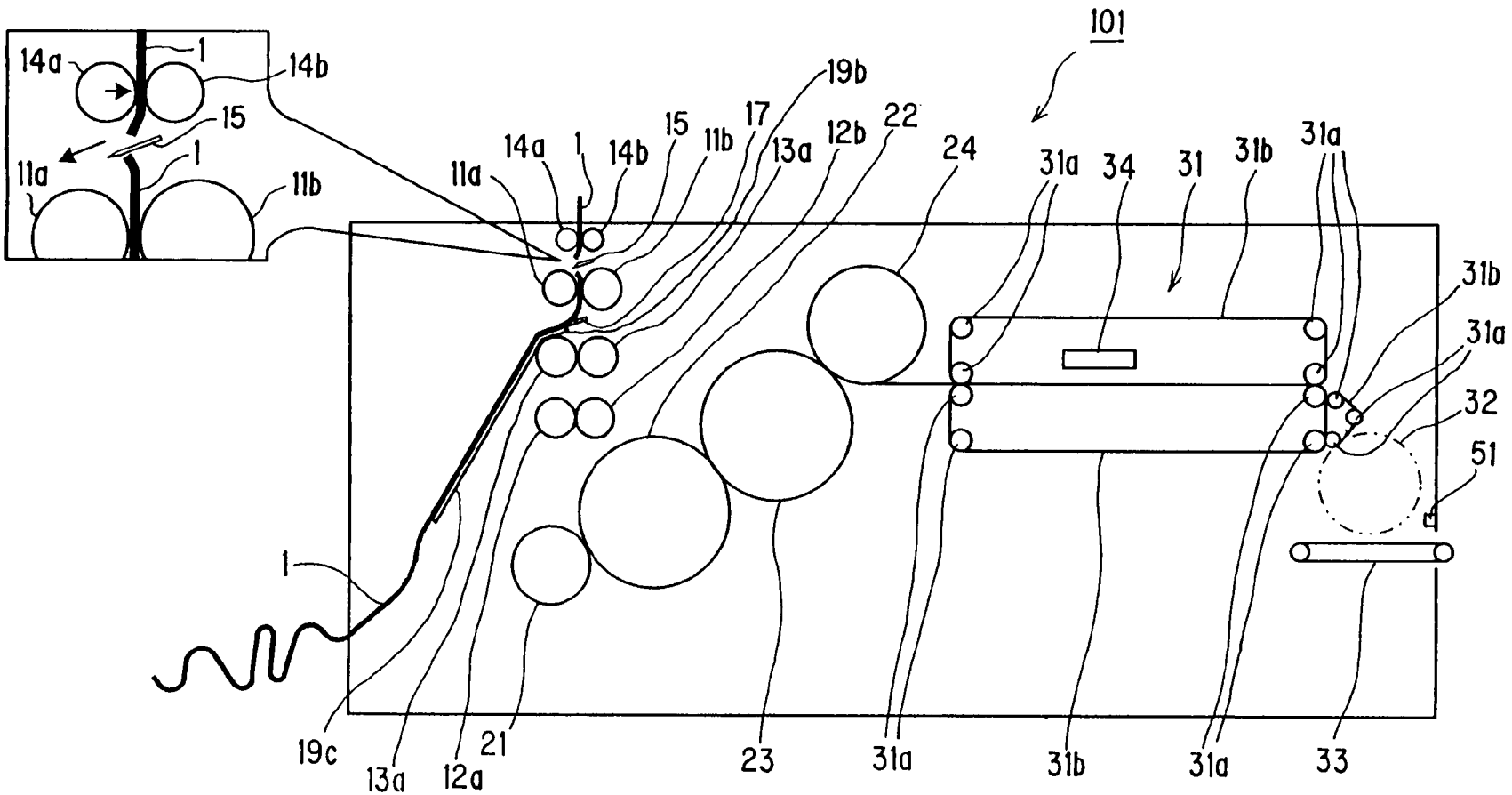
FIG. 11 is an explanatory view for explaining an action subsequent to the action of FIG. 10.
Figure 12:
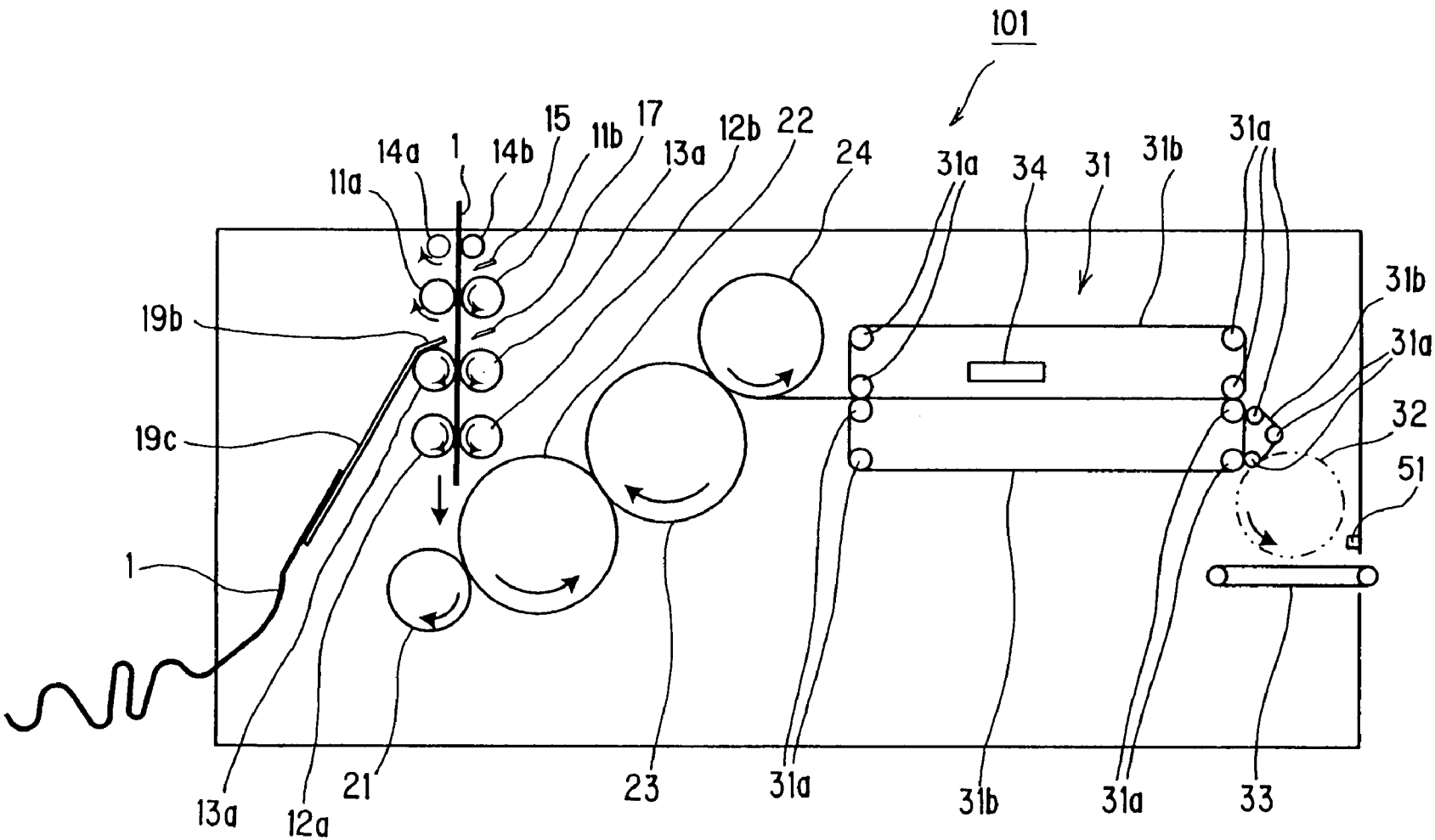
FIG. 12 is an explanatory view for explaining an action subsequent to the action of FIG. 11.
Figure 13:
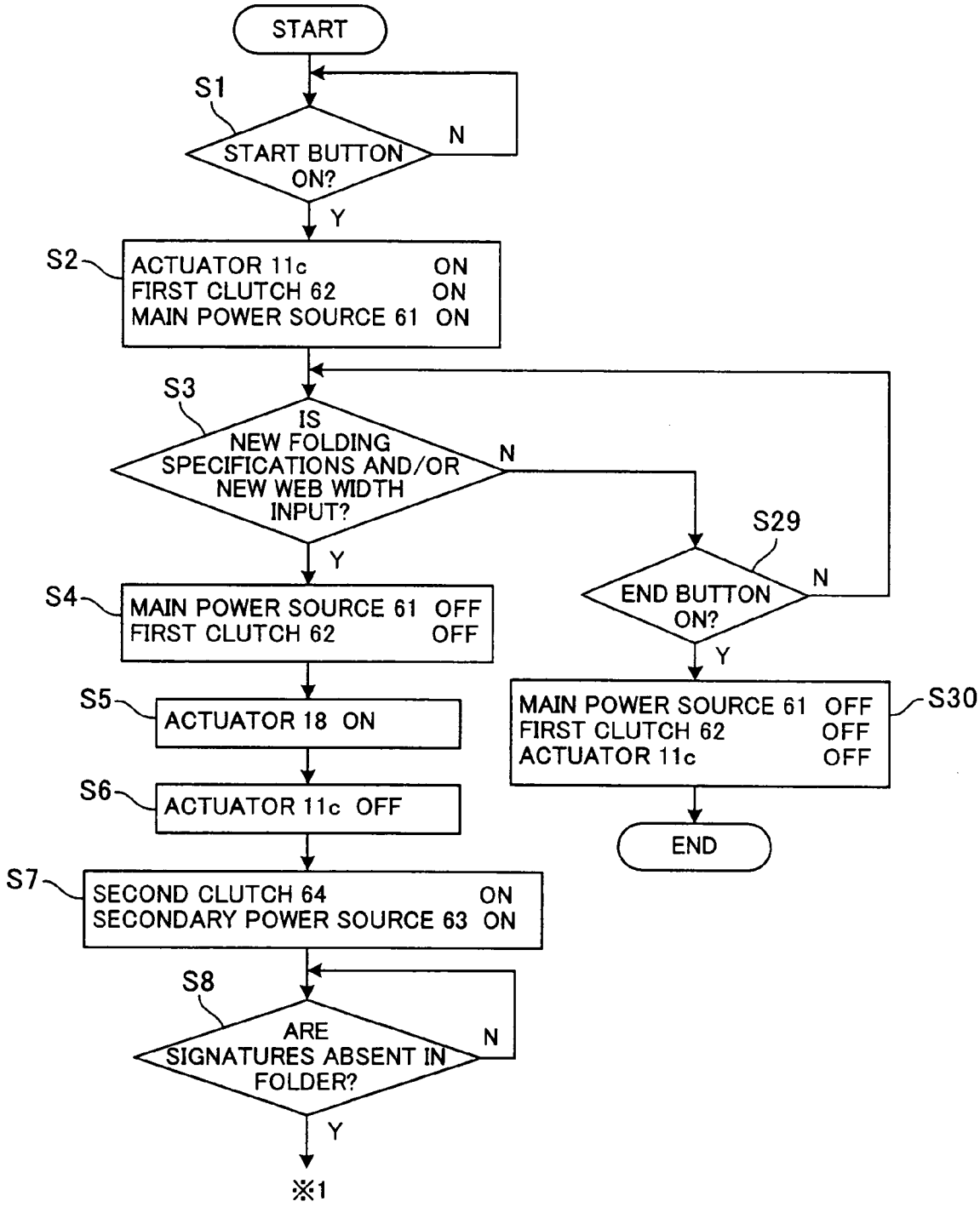
FIG. 13 is a flowchart of a control system of the embodiment of the folder according to the present invention shown in FIG. 6.
Figure 14:
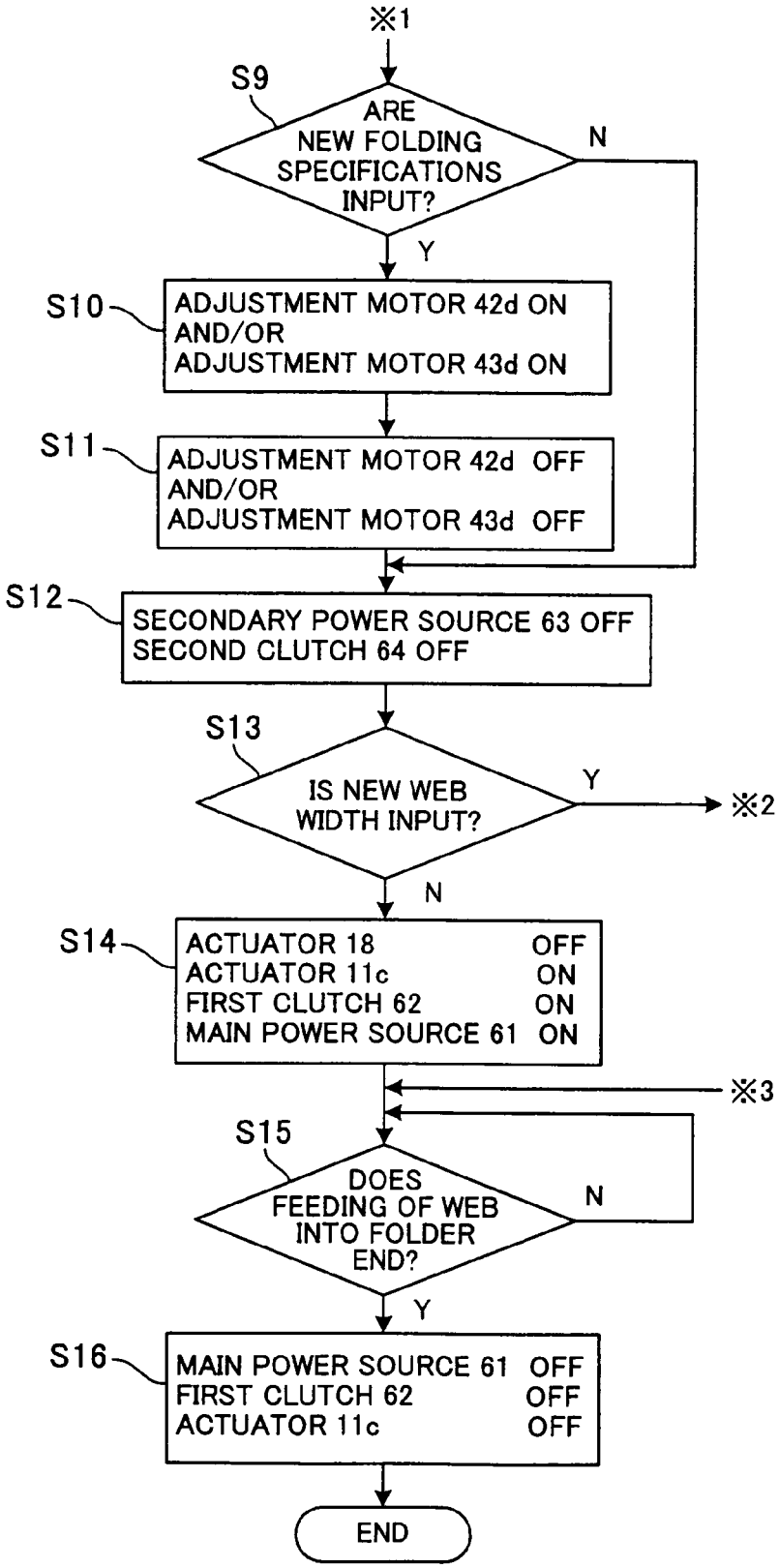
FIG. 14 is a flowchart continued from FIG. 13.

Next, the operation of the thus-configured folder 101 according to the present embodiment will be described with reference to FIGS. 7 to 15. FIG. 7 is an explanatory view for explaining an action of the folder; FIG. 8 is an explanatory view for explaining an action subsequent to the action of FIG. 7; FIG. 9 is an explanatory view for explaining an action subsequent to the action of FIG. 8; FIG. 10 is an explanatory view for explaining an action subsequent to the action of FIG. 8; FIG. 11 is an explanatory view for explaining an action subsequent to the action of FIG. 10; FIG. 12 is an explanatory view for explaining an action subsequent to the action of FIG. 11; FIG. 13 is a flowchart of the control system; FIG. 14 is a flowchart continued from FIG. 13; and FIG. 15 is a flowchart continued from FIG. 14.

Figure 15:
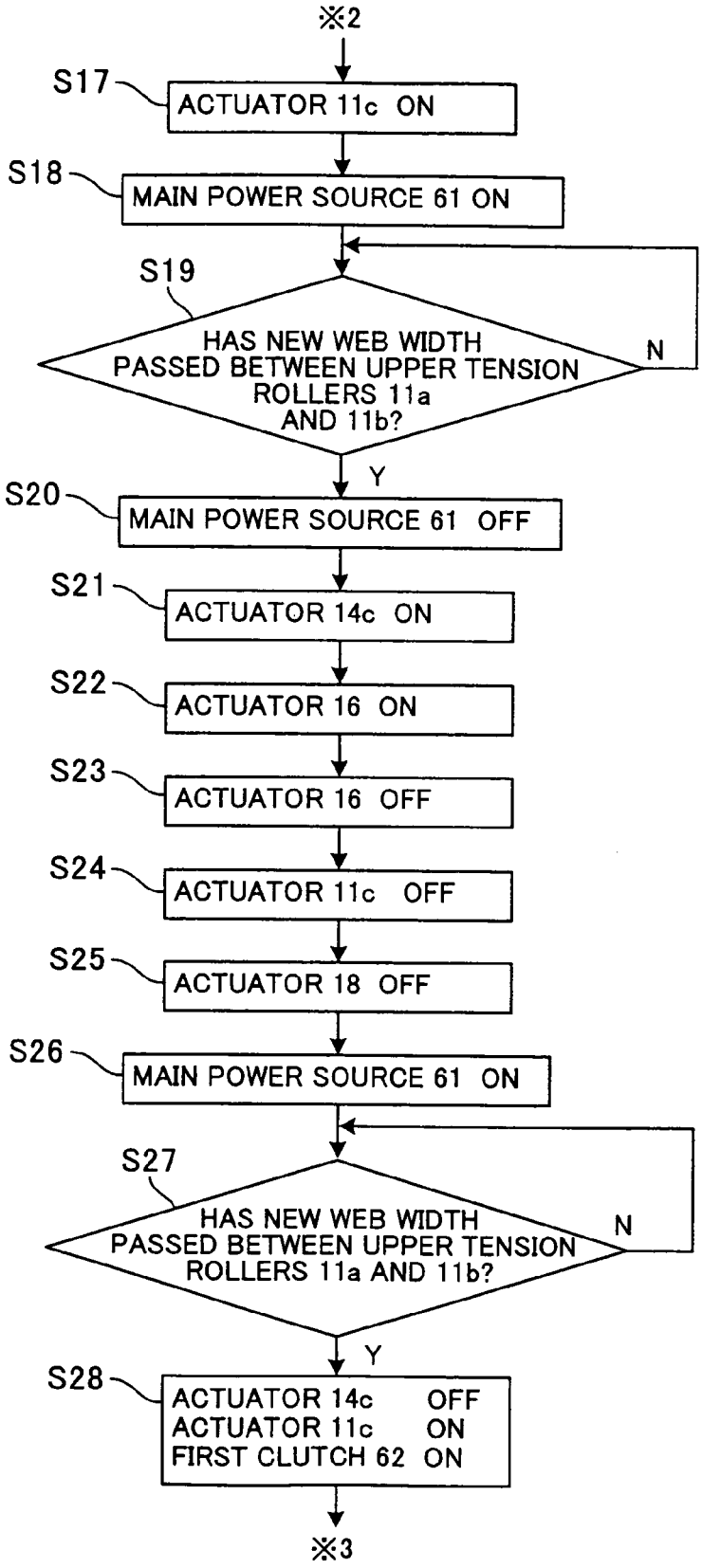
FIG. 15 is a flowchart continued from FIG. 14.

As shown in FIGS. 13 to 15, when a start button is turned ON (S1), the control device 50 causes the actuator 11*c* to extend (ON) so as to bring the upper tension roller 11*a* in contact with the other upper tension roller 11*b*, brings the first clutch 62 into an engaged state (ON), and activates the main power source 61 (ON) (S2). At this time, the second clutch 64 is into a disengaged state (OFF), and the secondary power source 63 is stopped.

When the fed web 1 passes through between the cross perforating cylinder 13*a* and the bearing cylinder 13*b* via the upper tension rollers 11*a* and 11*b*, the cross perforating cylinder 13*a* perforates the web 1 across its width at predetermined longitudinal intervals. Subsequently, while the web 1 is passing through between the cut-off cylinder 21 and the folding cylinder 22 via the lower tension rollers 12*a* and 12*b*, the cut-off cylinder 21 cuts the web 1 at the predetermined longitudinal intervals into sheets. The sheets are held on the folding cylinder 22.

When the sheet held on the folding cylinder 22 is conveyed to the contact position where the folding cylinder 22 is in contact with the first jaw cylinder 23, a folding blade 22*b* of the folding cylinder 22 and a gripper board 23*a* of the first jaw cylinder 23 cooperatively perform gripping change on the sheet in such a manner that the sheet is folded and gripped by the first jaw cylinder 23. Thus, the sheet is held on the first jaw cylinder 23 in the form of the signature 2.

When the signature 2 held on the first jaw cylinder 23 is conveyed to the contact position where the first jaw cylinder 23 is in contact with the second jaw cylinder 24, and is to be folded further, the folding blade 23*b* of the first jaw cylinder 23 and a gripper board 24*a* of the second jaw cylinder 24 cooperatively perform gripping change on the signature 2 in such a manner that the signature 2 is folded further and gripped by the second jaw cylinder 24. In the case where the signature 2 does not need to be folded further, the signature 2 merely undergoes gripping change from the first jaw cylinder 23 to the second jaw cylinder 24 and is held on the second jaw cylinder 24.

The signature 2 held on the second jaw cylinder 24 is transferred to the conveyance belts 31*b* of the conveyor apparatus 31 and conveyed by the conveyor apparatus 31. The thus-conveyed signature 2 is delivered onto the delivery conveyor 33 via the fan wheel 32 and conveyed to the next step. When the folding specifications or the paper width is not required to be changed to new folding specifications or a new paper width, and the set number of signatures 2 have been ejected to the conveyor apparatus 31, an end button is turned ON (S29). In response thereto, the control device 50 stops the operation of the main power source 61 (OFF), brings the first clutch 62 into a disengaged state (OFF), and causes the actuator 11*c* to contract (OFF) so as to separate the upper tension roller 11*a* away from the other upper tension roller 11*b* (S30). Thus, the folding operation ends.

During the fed web 1 being formed into the signatures 2 as described above, for example, when at least one of the paper width and the folding specifications of the signatures 2 is to be changed, at least one of a new paper width and new folding specifications is input to the control device 50 (S3). In response thereto, the control device 50 stops (OFF) the operation of the main power source 61 in such a manner that the printing phase of the web 1 is brought to a predetermined position. Subsequently, the control device 50 brings the first clutch 62 into a disengaged state (OFF) (S4).

Next, the control device 50 causes the actuator 18 to extend (ON) (S5) so as to cut the web 1 by means of the cutting blade 17 (FIG. 7). The guide plate 19*a* prevents the cut web 1 located upstream of the cutting blade 17 with respect to the feed direction from being caught between the cross perforating cylinder 13*a* and the bearing cylinder 13*b*.

Subsequently, the control device 50 causes the actuator 11*c* to contract (OFF) (S6) so as to move the upper tension roller 11*a* away from the other upper tension roller 11*b*, thereby preventing feed of the cut web 1 located on the upstream of the cutting blade 17 in the feed direction. Then, the control device 50 brings the second clutch 64 into an engaged state (ON) and activates the secondary power source 63 (ON) (S7). Thus, only the cylinders 21 to 24, the conveyor apparatus 31, the fan wheel 32, and the delivery conveyor 33 are operated so as to eject, to the exterior of the folder 101, a piece of the web 1, sheets, and the signatures 2 remaining on or between the lower tension rollers 12*a* and 12*b*, the cylinders 13*a*, 13*b*, 21 to 24, the conveyor apparatus 31, the fan wheel 32, and the delivery conveyor 33; i.e., a piece of the web 1, sheets, and the signatures 2 located downstream of the cutting blade 17 with respect to the feed direction (FIG. 8).

When the control device 50 determines, on the basis of a signal from the signature sensor 51, that all of the signatures 2 and the like remaining in the folder 101 have been ejected (S8), if new folding specifications are selectively input (S9), the control device 50 activates the phase adjustment motors 42*d* and 43*d* and the like so as to modify settings of (adjust) internal mechanisms, such as the cylinders 21 to 24 and the conveyor apparatus 31, of the folder 101, in accordance with the newly input folding specifications (S10, S11). On the other hand, if new folding specifications are not selectively input, the control device 50 does not activate the phase adjustment motors 42*d* and 43*d* and the like, and skips these steps.

Next, the control device 50 stops the operation of the secondary power source 63 (OFF), brings the second clutch 64 into a disengaged state (OFF) (S12). If a new paper width of the web 1 is not input (S13), the control device 50 causes the actuator 18 to contract (OFF) so as to return the cutting blade 17 and the guide plate 19*a* to their original positions. Also, the control device 50 causes the actuator 11*c* to extend (ON) so as to bring the upper tension roller 11*a* into contact with the other upper tension roller 11*b*. Subsequently, the control device 50 brings the first clutch 62 into an engaged state (ON) and activates the main power source 61 (ON) (S14) to thereby start the feed, to the paper feed path, of the cut web 1 on the upstream side with respect to the feed direction (FIG. 9).

When the control device 50 detects, on the basis of a signal from the signature sensor 51, that the signature 2 has been conveyed to the delivery conveyor 33; i.e., the web 1 has been fed to the interior of the folder 101 (S15), the control device 50 stops the operation of the main power source 61 (OFF), brings the first clutch 62 into a disengaged state (OFF), causes the actuator 11*c* to contract (OFF) so as to separate the upper tension roller 11*a* away from the other upper tension roller 11*b* (S16). Thus, setting of the new folding specifications ends.

Meanwhile, during the fed web 1 being formed into the signatures 2, for example, when the web 1 of a different width is spliced to the preceding web 1; i.e., a new paper width is selectively input (S13), the control device 50 causes the actuator 11*c* to extend (ON) (S17) so as to bring the upper tension roller 11*a* into contact with the other upper tension roller 11*b*, thereby allowing feed of the upstream web 1 formed as a result of cutting. Also, the control device 50 activates the main power source 61 (ON) (S18), thereby rotating the upper tension rollers 11*a* and 11*b*. Accordingly, the upstream web 1 formed as a result of cutting is guided to the paper ejection path along the guide plates 19*a* to 19*c* (FIG. 10). Notably, at this time, the first clutch 62 and the second clutch 64 are each brought into a disengaged state, and operation of the secondary power source 63 is stopped.

When web feed amount detection means such as a rotary encoder provided in the printing apparatus 103 determines, on the basis of the feed amount of the web 1, that the leading end of the newly spliced web 1 has reached the guide plates

19*a* to 19*c*; i.e., when the web 1 having a new paper width has reached the position facing the cutting blade 15 (S19), the control device 50 temporarily stops the operation of the main power source 61 (OFF) (S20), causes the actuator 14*c* to extend (ON) (S21) so as to bring the auxiliary roller 14*a* into contact with the other auxiliary roller 14*b*, thereby holding the web 1 between the auxiliary rollers 14*a* and 14*b*. Subsequently, the control device 50 causes the actuator 16 to extends (ON) (S22) so as to cut the web 1 at a position between the auxiliary rollers 14*a* and 14*b* and the upper tension rollers 11*a* and 11*b* by means of the cutting blade 15 (see FIG. 11).

Subsequently, the control device 50 causes the actuator 16 to contract (OFF) (S23) so as to return the cutting blade 15 to the original position. Further, the control device 50 causes the actuator 11*c* to contract (OFF) (S24) so as to separate the upper tension roller 11*a* away from the other upper tension roller 11*b*. AS a result, the leading end of he newly spliced web 1 is ejected to the paper ejection path.

Subsequently, the control device 50 causes the actuator 18 to contract (OFF) (S25) so as to return the cutting blade 17 and the guide plate 19*a* to their original positions. Also, the control device 50 activates the main power source 61 (ON) (S26), thereby rotating the auxiliary rollers 14*a* and 14*b*. As a result, the upstream web 1 formed as a result of cutting by the cutting blade 15 begins to be fed to the paper feed path. When the web feed amount detection means such as a rotary encoder provided in the printing apparatus 103 determines, on the basis of the feed amount of the web 1, that the leading end of the web 1 has passed between the upper tension rollers 11*a* and 11*b* (S27), the control device 50 causes the actuator 14*c* to contract (OFF) so as to move the auxiliary roller 14*a* away from the other auxiliary roller 14*b*. Further, the control device 50 causes the actuator 11*c* to extend (ON) so as to bring the upper tension roller 11*a* into contact with the upper tension roller 11*b*, thereby changing over rollers for feeding the web 1 from the auxiliary rollers 14*a* and 14*b* to the upper tension rollers 11*a* and 11*b*. Also, the control device 50 brings the first clutch 62 into an engaged state (ON), and operates the cylinders 21 to 24, the conveyor apparatus 31, the fan wheel 32, and the delivery conveyor 33 as well (S28) (see FIG. 12).

When the control device 50 detects, on the basis of a signal from the signature sensor 51, that the signature 2 has been conveyed to the delivery conveyor 33; i.e., the web 1 has been fed to the interior of the folder 101 (S15), the control device 50 stops the operation of the main power source 61 (OFF), brings the first clutch 62 into a disengaged state (OFF), causes the actuator 11*c* to contract (OFF) so as to separate the upper tension roller 11*a* from the upper tension roller 11*b* (S16). Thus, setting to the new paper width ends.

As described above, even when folding specifications for the signatures 2 are to be changed in the course of printing or even when the width of the web 1 is changed as a result of connection of the web 1 of a different width to the preceding web 1, the folder 101 according to the present embodiment frees an operator of the following work: manual removal of a piece of the web 1, sheets, and the signatures 2 from the interior of the folder 101 and subsequent modification of settings (adjustment) of internal mechanisms, such as the cylinders 21 to 24 and the conveyor apparatus 31, of the folder 101.

Thus, the folder 101 according to the present embodiment can readily cope with a change in the width of the web 1 or folding specifications, thereby greatly enhancing work efficiency and reducing printing cost.

In the present embodiment, when a web 1 having a different width has been spliced to the original web 1; i.e., when a new paper width has been selectively input (S13), the first clutch 62 and the second clutch 64 are each brought into a disengaged state, operation of the secondary power source 63 is stopped, and the main power source 61 is activated, whereby the rollers 11*a*, 12*a*, and 14*a*, the cross perforating cylinder 13*a*, and the bearing cylinder 13*b* are operated, without operating the cylinders 21 to 24, the conveyor apparatus 31, the fan wheel 32, and the delivery conveyor 33 (S17 to S27). However, it is possible to operate the rollers 11*a*, 12*a*, and 14*a*, the cross perforating cylinder 13*a*, and the bearing cylinder 13*b*, without operating the cylinders 21 to 24, the conveyor apparatus 31, the fan wheel 32, and the delivery conveyor 33, by bringing the first clutch 62 into a disengaged state, stopping the operation of the secondary power source 63 with the second clutch 64 maintained in an engaged state, and activating the main power source 61.

Figure 16:
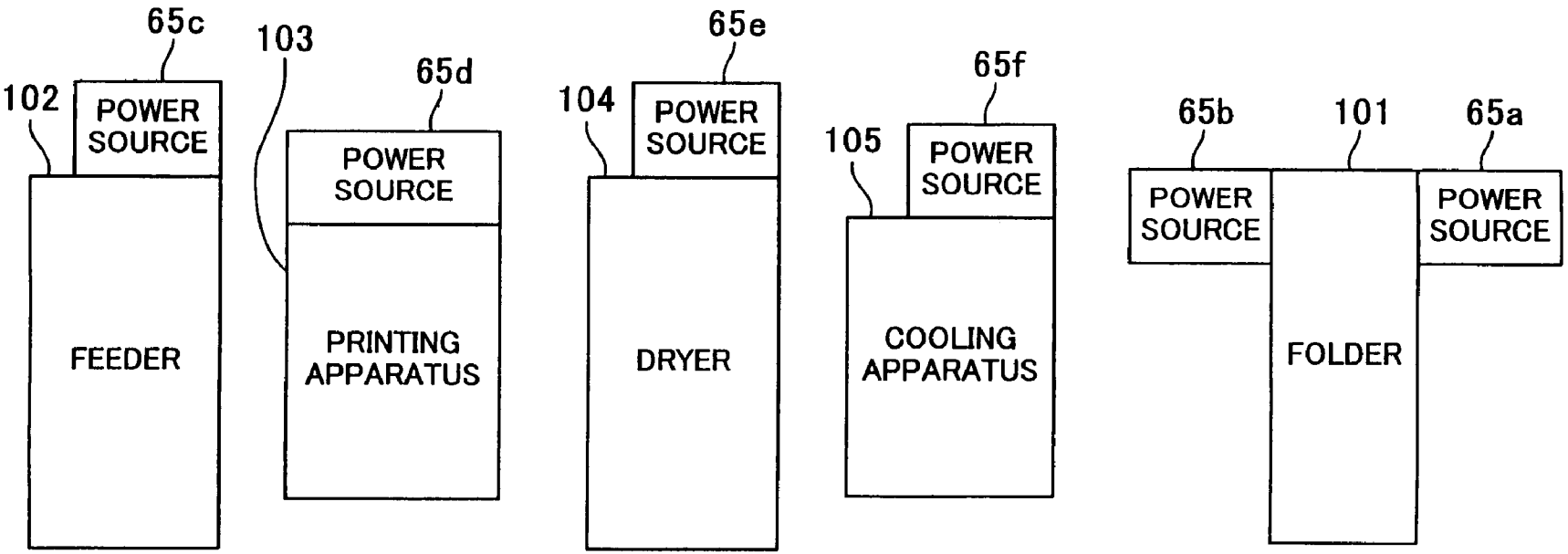
FIG. 16 is a block diagram of a drive system for an embodiment of a printing press into which the folder according to the present invention is incorporated.
Figure 17:
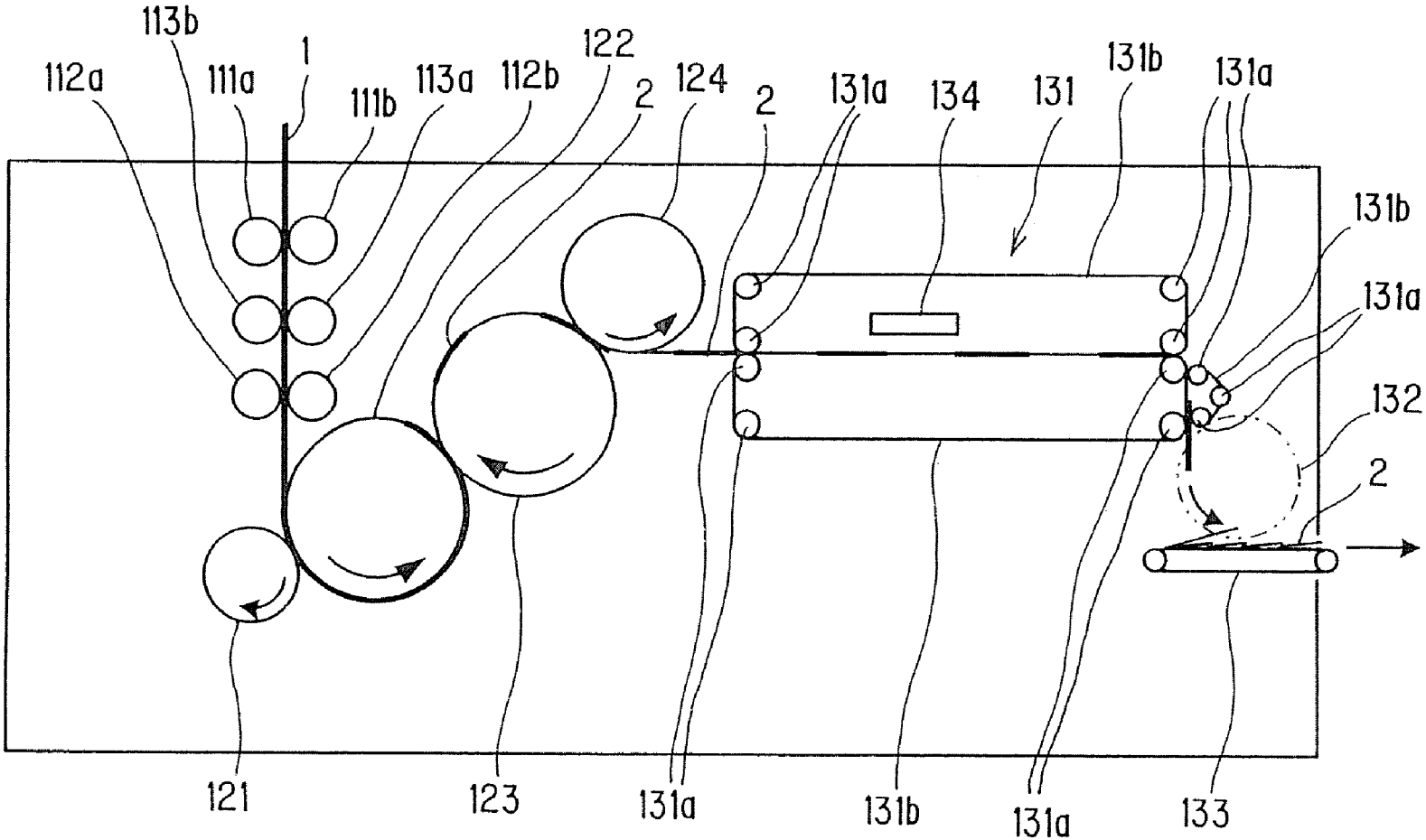
FIG. 17 PRIOR ART
FIG. 17 is a schematic, overall, configurational view of a conventional folder.

As shown in FIG. 5, according to the present embodiment, the drive gear 40, the conveyor apparatus 31, the fan wheel 32, and the delivery conveyor 33 are connected, via the first clutch 62, to the power transmission system of the main power source 61, which powers the feeder 102, the printing apparatus 103, the dryer 104, the cooling apparatus 105, and the like of the printing press, as well as to the secondary power source 63 via the second clutch 64, the secondary power source 63 exclusively powering the drive gear 40, the conveyor apparatus 31, the fan wheel 32, and the delivery conveyor 33. The rollers 11*a*, 12*a*, and 14*a*, the cross perforating cylinder 13*a*, and the bearing cylinder 13*b* are connected to the power transmission system of the main power source 61 in the same manner as the feeder 102, the printing apparatus 103, the dryer 104, the cooling apparatus 105, and the like of the printing press; i.e., directly connected to the power transmission system of the main power source 61 without passing through the first clutch 62. However, a configuration as shown in FIG. 16 may be employed. A power source 65*a* for supplying power only to the drive gear 40, the conveyor apparatus 31, the fan wheel 32, and the delivery conveyor 33 and a power source 65*b* for supplying power only to the rollers 11*a*, 12*a*, and 14*a*, the cross perforating cylinder 13*a*, and the bearing cylinder 13*b* are provided in the folder 101. Further, power sources 65*c* to 65*f* are individually provided for the feeder 102, the printing apparatus 103, the dryer 104, and the cooling apparatus 105 of the printing press. Control means activates the power sources 65*a* to 65*f* synchronously or individually.

The present embodiment is described while mentioning modification of settings (adjustment) of folder mechanisms by means of controlling the main power source 61, the secondary power source 63, the clutches 62 and 64, the first web cutting means, the second web cutting means, and the like. However, settings (adjustments) of folder mechanisms may be modified by means of controlling the main power source 61, the first web cutting means, the second web cutting means, and the like. In this case, at the time of changeover of folding specifications, the upstream web 1 formed as a result of cutting by the cutting blade 17 continues being ejected regardless of whether or not the width of the web 1 is changed, and the downstream web 1 is conveyed toward the delivery conveyor 33.

What is claimed is:

1. A folder, comprising:

a cut-off unit that cuts fed web into sheets;

a folding unit that folds said sheets into signatures in accordance with selected folding specifications;

a signature conveyance unit that conveys said signatures;

a first web cutting unit disposed upstream of said cut-off unit with respect to a feed direction of said web and adapted to cut said web; and a control unit, operable when the folding specifications of said signatures are changed or a width of said web is changed, for operating said first web cutting unit so as to cut said web, and for causing said cut web present downstream of said first web cutting unit with respect to the feed direction to be fed to said signature conveyance unit.

2. A folder according to claim 1, wherein when the folding specifications of said signatures are changed, said control unit adjusts said folding unit on the basis of new folding specifications.

3. A folder according to claim 1, further comprising:

a signature detection unit that detects the presence/absence of said signature on said signature conveyance unit, wherein when the folding specifications of said signatures are changed, said control unit adjusts said folding unit on the basis of a signal from said signature detection unit.

4. A folder according to claim 1, wherein said signature conveyance unit is disposed downstream of said folding unit with respect to the conveyance direction of said signature.

5. A folder according to claim 1, wherein said cut-off unit comprises a cut-off cylinder having a cut-off knife;

said folding unit comprises a group of cylinders including a folding cylinder which has a pin for holding said sheet produced as a result of cutting of said web, and a folding blade for folding said sheet at an arbitrary position; and said signature conveyance unit receives said signatures from said group of cylinders and conveys said signatures.

6. A folder, comprising:

a cut-off unit that cuts fed web into sheets;

a folding unit that folds said sheets into signatures in accordance with selected folding specifications;

a signature conveyance unit that conveys said signatures;

a first web cutting unit disposed upstream of said cut-off unit with respect to a feed direction of said web and adapted to cut said web; and a control unit, operable when the folding specifications of said signatures are changed or a width of said web is changed, for operating said first web cutting unit so as to cut said web, and for causing said cut web present downstream of said first web cutting unit with respect to the feed direction to be fed to said signature conveyance unit, wherein when the folding specifications of said signatures are changed, said control unit adjusts said folding unit on the basis of new folding specifications, wherein said folding unit comprises:

a double-cylinder-type folding cylinder composed of a folding-cylinder first cylinder and a folding-cylinder second cylinder coaxially assembled to said folding-cylinder first cylinder in such a manner that said folding-cylinder second cylinder can move in a circumferential direction, wherein a pin for holding a sheet produced as a result of cutting of said web by said cut-off unit is provided on said fold-cylinder first cylinder, and a folding blade for folding said sheet is provided on said folding-cylinder second cylinder;

a double-cylinder-type first jaw cylinder composed of a first-jaw-cylinder first cylinder and a first-jaw-cylinder second cylinder coaxially assembled to said first-jaw-cylinder first cylinder in such a manner that said first-jaw-cylinder second cylinder can move in a circumferential direction, wherein a gripper board for gripping a folded portion of said sheet folded by said folding cylinder is provided on said first-jaw-cylinder first cylinder, and a folding blade for folding a signature, which has been formed as a result of the sheet being folded, is provided on said first-jaw-cylinder second cylinder;

a folding-cylinder phase adjustment unit that adjusts a phase relation between said folding-cylinder first cylinder and said folding-cylinder second cylinder; and a first-jaw-cylinder phase adjustment unit that adjusts a phase relation between said first-jaw-cylinder first cylinder and said first-jaw-cylinder second cylinder, wherein said control unit operates said folding-cylinder phase adjustment unit and said first-jaw-cylinder phase adjustment unit on the basis of new folding specifications.

7. A folder, comprising:

a cut-off unit that cuts fed web into sheets;

a folding unit that folds said sheets into signatures in accordance with selected folding specifications;

a signature conveyance unit that conveys said signatures;

a first web cutting unit disposed upstream of said cut-off unit with respect to a feed direction of said web and adapted to cut said web;

a control unit, operable when the folding specifications of said signatures are changed or a width of said web is changed, for operating said first web cutting unit so as to cut said web, and for causing said cut web present downstream of said first web cutting unit with respect to the feed direction to be fed to said signature conveyance unit, and a feed direction changeover unit disposed upstream of said first web cutting unit with respect to the feed direction and adapted to change a web feed direction so as to guide to a web ejection path said upstream web formed as a result of cutting, wherein when the width of said web is changed, said control unit operates said feed direction changeover unit on the basis of a new web width in such a manner as to guide, to said web ejection path, said cut web present on the upstream side of said first web cutting unit with respect to the feed direction.

8. A folder according to claim 7, further comprising:

a web feed unit disposed upstream of said feed direction changeover unit with respect to the feed direction and adapted to feed said web, wherein said control unit operates said web feed unit to eject, to said web ejection path, said cut web present on the upstream side of said first web cutting unit with respect to the feed direction.

9. A folder according to claim 8, further comprising:

a web feed amount detection that detects a feed amount of said web, wherein said control unit control means stops the operation of said web feed unit on the basis of a signal from said web feed amount detection means.

10. A folder according to claim 9, further comprising:

a second web cutting unit disposed upstream of said web feed unit with respect to the feed direction and adapted to cut said web;

wherein said control unit operates said second web cutting unit so as to cut a leading end portion of said web having a new width fed to said web ejection path.

11. A folder according to claim 10, wherein said control unit operates said feed direction change over unit in such a manner as to guide, to a web feed path, said web cut by said second web cutting unit and located on the upstream side of said second web cutting unit with respect to the feed direction.

12. A folder according to claim 7, further comprising:

a signature detection unit that detects the presence/absence of said signature on said signature conveyance means, wherein said control unit operates said feed direction changeover unit on the basis of a signal from said signature detection unit.

13. A folder according to claim 12, further comprising:

a signature detection unit that detects the presence/absence of said signature on said signature conveyance unit, wherein when the folding specifications of said signatures are changed, said control unit ejects said signatures from said cut-off unit means, said folding unit, and said signature conveyance unit, on the basis of a signal from said signature detection unit.

14. A folder, comprising:

a cut-off unit that cuts fed web into sheets;

a folding unit that folds said sheets into signatures in accordance with selected folding specifications;

a signature conveyance unit that conveys said signatures;

a first web cutting unit disposed upstream of said cut-off unit with respect to a feed direction of said web and adapted to cut said web;

a control unit, operable when the folding specifications of said signatures are changed or a width of said web is changed, for operating said first web cutting unit so as to cut said web, and for causing said cut web present downstream of said first web cutting unit with respect to the feed direction to be fed to said signature conveyance unit;

a feed direction changeover unit disposed upstream of said first web cutting unit with respect to the feed direction and adapted to change a web feed direction so as to guide, to said web ejection path, said cut web present on the upstream side of said first web cutting unit with respect to the feed direction;

a web feed unit disposed upstream of said feed direction changeover unit with respect to the feed direction and adapted to feed said web;

a web feed amount detection means that detects a feed amount of said web; and a second web cutting unit disposed upstream of said web feed unit with respect to the feed direction and adapted to cut said web, wherein when the folding specifications are changed to new folding specifications, said control unit adjusts said folding unit on the basis of a signal from said signature detection unit, and when the web width is switched to a new web width, said control unit, after operating said feed direction changeover unit in such a manner as to guide, to said web ejection path, said cut web present on the upstream side of said first web cutting unit with respect to the feed direction, operates said web feed unit to eject, to said web ejection path, said cut web present on the upstream side of said first web cutting unit with respect to the feed direction, stops the operation of said web feed unit when said web having a new width reaches a position facing said second web cutting unit, operates said second web cutting unit so as to cut said web having a new width, and operates said feed direction changeover unit in such a manner as to guide, to a web feed path, said web having a new width cut by said second web cutting unit and located on the upstream side of said second web cutting unit with respect to the feed direction.

15. A folder according to claim 14, wherein said cut-off unit, said folding unit, and said signature conveyance unit are designed to be operated by power from a main power source;

said web feed unit comprises first feed rollers which are paired to nip said web and operated by the power from said main power source;

said folder comprises a secondary power source for operating said cut-off unit, said folding unit, and said signature conveyance unit, a first clutch provided between said main power source and said cut-off unit, said folding unit, and said signature conveyance unit, and a second clutch provided between said secondary power source and said cut-off unit, said folding unit, and said signature conveyance unit;

when said cut-off unit, said folding unit, said signature conveyance unit, and said first feed rollers are to be operated, said control unit brings said second clutch into a disengaged state, brings said first clutch into an engaged state, and activates said main power source;

when said first feed rollers are to be operated without operating said cut-off unit, said folding unit, and said signature conveyance unit, said control unit brings each of said first and second clutches into a disengaged state and activates said main power source, or said control unit brings said first clutch into a disengaged state, stops said secondary power source, and activates said main power source; and when only said cut-off unit, said folding unit, and said signature conveyance unit are to be operated, said control unit brings said first clutch into a disengaged state, stops said main power source, brings said second clutch into an engaged state, and activates said secondary power source.

* * * * *